US010375488B2

(12) United States Patent
Ruppersberg et al.

(10) Patent No.: US 10,375,488 B2
(45) Date of Patent: Aug. 6, 2019

(54) SYSTEMS, DEVICES, COMPONENTS AND METHODS FOR REDUCING FEEDBACK BETWEEN MICROPHONES AND TRANSDUCERS IN BONE CONDUCTION MAGNETIC HEARING DEVICES

(71) Applicant: SOPHONO, INC., Boulder, CO (US)

(72) Inventors: Peter Ruppersberg, Blonay (CH); Markus C. Haller, Nyon (CH); Todd C. Wyant, Louisville, CO (US); Nicholas F. Pergola, Arvada, CO (US)

(73) Assignee: Sophono, Inc., Minneapolis, MN (US)

( * ) Notice: Subject to any disclaimer, the term of this patent is extended or adjusted under 35 U.S.C. 154(b) by 0 days.

(21) Appl. No.: 15/313,837

(22) PCT Filed: May 22, 2015

(86) PCT No.: PCT/US2015/032127

§ 371 (c)(1),
(2) Date: Nov. 23, 2016

(87) PCT Pub. No.: WO2015/183723

PCT Pub. Date: Dec. 3, 2015

(65) Prior Publication Data

US 2017/0208398 A1 Jul. 20, 2017

(51) Int. Cl.
*H04R 25/00* (2006.01)
*H04R 1/28* (2006.01)

(52) U.S. Cl.
CPC ..... *H04R 25/456* (2013.01); *H04R 1/288* (2013.01); *H04R 25/453* (2013.01); *H04R 25/604* (2013.01); *H04R 25/608* (2013.01); *H04R 2410/01* (2013.01); *H04R 2460/13* (2013.01)

(58) Field of Classification Search
CPC .... H04R 25/456; H04R 1/288; H04R 25/453; H04R 25/604; H04R 25/608; H04R 2410/01; H04R 2460/13
USPC ..... 381/324
See application file for complete search history.

(56) References Cited

U.S. PATENT DOCUMENTS

| | | | | |
|---|---|---|---|---|
| 4,612,915 | A | 9/1986 | Hough | |
| 8,199,939 | B2 * | 6/2012 | Suvanto | H04R 19/005 381/175 |
| 8,406,443 | B2 | 3/2013 | Westerkull et al. | |
| 9,020,174 | B2 | 4/2015 | Asnes | |
| 2002/0025055 | A1 * | 2/2002 | Stonikas | H04R 25/652 381/322 |
| 2002/0143242 | A1 * | 10/2002 | Nemirovski | H04B 1/3877 600/300 |

(Continued)

FOREIGN PATENT DOCUMENTS

| | | | |
|---|---|---|---|
| DE | 202004006117 | U1 | 7/2004 |
| DE | 202004008719 | U1 | 10/2004 |

(Continued)

*Primary Examiner* — Sunita Joshi

(57) ABSTRACT

Disclosed are various embodiments of systems, devices, components and methods for reducing feedback between a transducer and one or more microphones in a magnetic bone conduction hearing device. Such systems, devices, components and methods include acoustically sealing or welding first and second compartments of the hearing device from one another, where the first compart contains the one or more microphones, and the second compart contains the transducer.

7 Claims, 17 Drawing Sheets

(56) References Cited

U.S. PATENT DOCUMENTS

| | | | | |
|---|---|---|---|---|
| 2007/0053536 | A1 | 3/2007 | Westerkull | |
| 2009/0247814 | A1* | 10/2009 | Parker | H04R 25/70 600/25 |
| 2009/0248155 | A1 | 10/2009 | Parker | |
| 2010/0054513 | A1* | 3/2010 | Bally | H04R 25/456 381/322 |
| 2012/0078035 | A1 | 3/2012 | Andersson et al. | |
| 2012/0080039 | A1 | 4/2012 | Siegert | |
| 2012/0294466 | A1 | 11/2012 | Kristo et al. | |
| 2013/0150657 | A1 | 6/2013 | Leigh et al. | |
| 2014/0064531 | A1 | 3/2014 | Andersson et al. | |
| 2014/0163692 | A1 | 6/2014 | Van den Heuvel et al. | |
| 2014/0275731 | A1 | 9/2014 | Andersson et al. | |
| 2014/0336447 | A1 | 11/2014 | Bjorn et al. | |
| 2015/0038775 | A1 | 2/2015 | Ruppersberg | |
| 2015/0043766 | A1 | 2/2015 | Westerkull | |
| 2015/0063616 | A1 | 3/2015 | Westerkull | |
| 2015/0141740 | A1 | 5/2015 | Miller | |
| 2015/0146902 | A1 | 5/2015 | Jinton et al. | |
| 2015/0156594 | A1 | 6/2015 | Bervoets | |

FOREIGN PATENT DOCUMENTS

| | | | |
|---|---|---|---|
| DE | 202005015533 | U1 | 2/2006 |
| DE | 202006004445 | | 5/2006 |
| DE | 202005009361 | U1 | 11/2006 |
| DE | 102006026288 | A1 | 1/2007 |
| DE | 202009003507 | U1 | 7/2009 |
| DE | 202009003508 | U1 | 7/2009 |
| DE | 202009003509 | U1 | 7/2009 |
| DE | 202009005475 | | 7/2009 |
| DE | 202009005936 | | 8/2009 |
| DE | 202009007401 | | 10/2009 |
| DE | 112010001095 | | 10/2012 |
| EP | 755169 | | 5/1996 |
| WO | 2010/105601 | | 9/2010 |
| WO | 2015/020753 | A2 | 2/2015 |
| WO | 2015/034582 | A2 | 3/2015 |

* cited by examiner

ALPHA 1

BAHA

AUDIANT
(PRIOR ART)
NS
DSP
MIC
BAT
S
N
10
15
17
19
20
25
40
50
55
60
70
75
80
85
95
107
115

109
85a'
88a
85a
99a
109a
107
89

89
109
107
91
101
93

99a
88a
85a
103/104
107
89
101
TO 155
109

111
45
40
25
10
91
113
103/104

SYSTEMS, DEVICES, COMPONENTS AND METHODS FOR REDUCING FEEDBACK BETWEEN MICROPHONES AND TRANSDUCERS IN BONE CONDUCTION MAGNETIC HEARING DEVICES

PRIORITY CLAIM

This application claims the benefit of U.S. patent application Ser. No. 14/288,100, filed May 27, 2014.

FIELD OF THE INVENTION

Various embodiments of the invention described herein relate to the field of systems, devices, components, and methods for bone conduction and other types of hearing aid devices.

BACKGROUND

A magnetic bone conduction hearing aid is held in position on a patient's head by means of magnetic attraction that occurs between magnetic members included in the hearing aid and in a magnetic implant that has been implanted beneath the patient's skin and affixed to the patient's skull. Acoustic signals originating from an electromagnetic transducer located in the external hearing aid are transmitted through the patient's skin to bone in the vicinity of the underlying magnetic implant, and thence through the bone to the patient's cochlea. The acoustic signals delivered by the electromagnetic transducer are provided in response to external ambient audio signals detected by one or more microphones disposed in external portions of the hearing aid. The fidelity and accuracy of sounds delivered to a patient's cochlea, and thus heard by a patient, can be undesirably compromised or affected by many different factors, including hearing aid coupling to the magnetic implant, and hearing aid design and configuration.

What is needed is a magnetic hearing aid system that provides increased fidelity and accuracy of the sounds heard by a patient.

SUMMARY

In one embodiment, there is provided a bone conduction magnetic hearing aid comprising at least one microphone disposed in a first compartment of the hearing aid, the at least one microphone being configured to detect ambient sounds in a vicinity of the hearing aid, and a transducer disposed in a second compartment of the hearing aid, the transducer being configured to generate acoustic signals for transmission to a patient's skull, the acoustic signals generated by the transducer being representative of the ambient sounds detected by the at least one microphone, wherein the first compartment is separated from the second compartment by at least one wall or floor, and one or more seals or welds of seams, breeches, holes or leaks disposed between the first compartment and the second compartment are configured to prevent or inhibit the ingress of acoustic signals emanating from the second compartment into the first compartment through the seams, breeches, holes or leaks, and further wherein at least the first compartment, the at least one wall or floor, and the one or more seals are together configured to reduce the amount of feedback occurring between the transducer and the at least one microphone.

As used herein, the phrase "acoustic signal" is intended to be construed broadly to include any generation of a sound wave, a vibrational signal, a mechanical signal, an electrical signal, a sound signal or acoustic wave or signal, or any combinations thereof.

In another embodiment, there is provided a method of reducing feedback between a transducer and at least one microphone in a bone conduction magnetic hearing aid comprising providing a first compartment for the at least one microphone, the at least one microphone being configured to detect ambient sounds in a vicinity of the hearing aid, providing a second compartment for the transducer, the transducer being configured to generate acoustic signals for transmission to a patient's skull, the acoustic signals generated by the transducer being representative of the ambient sounds detected by the at least one microphone, and forming one or more seals or welds in one or more seams, breeches, holes or leaks disposed between the first compartment and the second compartment with at least one of a sealing material, an adhesive and an ultrasonic weld, the seals being configured to prevent or inhibit the ingress of acoustic signals emanating from the second compartment into the first compartment, and further wherein at least the first compartment, the at least one wall or floor, and the seals are together configured to reduce the amount of feedback occurring between the transducer and the at least one microphone.

In yet another embodiment, there is provided a bone conduction magnetic hearing aid comprising an electromagnetic ("EM") transducer disposed in at least one housing, at least one microphone disposed in, on or near the at least one housing, the microphone being configured to detect ambient sounds in the vicinity of the hearing aid, and a transducer encapsulation compartment disposed around the EM transducer and configured to attenuate or reduce the propagation of sound waves generated by the EM transducer to the at least one microphone.

In still another embodiment, there is provided a bone conduction magnetic hearing aid comprising an electromagnetic ("EM") transducer disposed in a main housing, and at least one microphone disposed in or on the main housing or in or on a microphone housing separate from the main housing, the microphone being configured to detect ambient sounds in the vicinity of the hearing aid, wherein the EM transducer is configured to generate sounds in response to the ambient sounds detected by the at least one microphone, and a microphone encapsulation compartment is disposed around the at least one microphone and configured to attenuate or reduce the propagation of sound waves generated by the EM transducer to the at least one microphone.

In yet a further embodiment, there is provided method of reducing feedback between a transducer and a microphone in a bone conduction magnetic hearing aid comprising providing a transducer encapsulation compartment around the transducer that is configured to attenuate or reduce the propagation of sound waves generated by the transducer to the microphone.

In a still further embodiment, there is provided a method of reducing feedback between a transducer and a microphone in a bone conduction magnetic hearing aid comprising providing a microphone encapsulation compartment or sound attenuating or absorbing material around the microphone that is configured to attenuate or reduce the propagation of sound waves generated by the transducer to the microphone.

Further embodiments are disclosed herein or will become apparent to those skilled in the art after having read and understood the specification and drawings hereof.

BRIEF DESCRIPTION OF THE DRAWINGS

Different aspects of the various embodiments will become apparent from the following specification, drawings and claims in which:

FIG. 2(*b*) shows one embodiment of a prior art wiring diagram for a SOPHONO ALPHA 1 hearing aid manufactured using an SA3286 DSP;

FIG. 3(*b*) shows one embodiment of a prior art SOPHONO ALPHA 1 hearing aid or device 10;

FIG. 3(*c*) shows another embodiment of a prior art SOPHONO ALPHA hearing aid or device 10;

FIGS. 10(*d*) and 10(*e*) show top side perspective exploded partial views of the hearing aid or device 10 of FIGS. 10(*a*) through 10(*c*), and FIGS. 11(*a*) and 11(*b*) show end views of an assembled hearing aid of FIGS. 10(*a*) and 10(*b*).

The drawings are not necessarily to scale. Like numbers refer to like parts or steps throughout the drawings.

DETAILED DESCRIPTIONS OF SOME EMBODIMENTS

Described herein are various embodiments of systems, devices, components and methods for bone conduction and/or bone-anchored hearing aids.

A bone-anchored hearing device (or "BAHD") is an auditory prosthetic device based on bone conduction having a portion or portions thereof which are surgically implanted. A BAHD uses the bones of the skull as pathways for sound to travel to a patient's inner ear. For people with conductive hearing loss, a BAHD bypasses the external auditory canal and middle ear, and stimulates the still-functioning cochlea via an implanted metal post. For patients with unilateral hearing loss, a BAHD uses the skull to conduct the sound from the deaf side to the side with the functioning cochlea. In most BAHD systems, a titanium post or plate is surgically embedded into the skull with a small abutment extending through and exposed outside the patient's skin. A BAHD sound processor attaches to the abutment and transmits sound vibrations through the external abutment to the implant. The implant vibrates the skull and inner ear, which stimulates the nerve fibers of the inner ear, allowing hearing. A BAHD device can also be connected to an FM system or music player by means of attaching a miniaturized FM receiver or Bluetooth connection thereto.

BAHD devices manufactured by COCHLEAR™ of Sydney, Australia, and OTICON™ of Smoerum, Denmark. SOPHONO™ of Boulder, Colo. manufactures an Alpha 1 magnetic hearing aid device, which attaches by magnetic means behind a patient's ear to the patient's skull by coupling to a magnetic or magnetized bone plate (or "magnetic implant") implanted in the patient's skull beneath the skin.

Surgical procedures for implanting such posts or plates are relatively straightforward, and are well known to those skilled in the art. See, for example, "Alpha I (S) & Alpha I (M) Physician Manual—REV A S0300-00" published by Sophono, Inc. of Boulder, Colo., the entirety of which is hereby incorporated by reference herein.

Figures 1A, 1B, 1C:
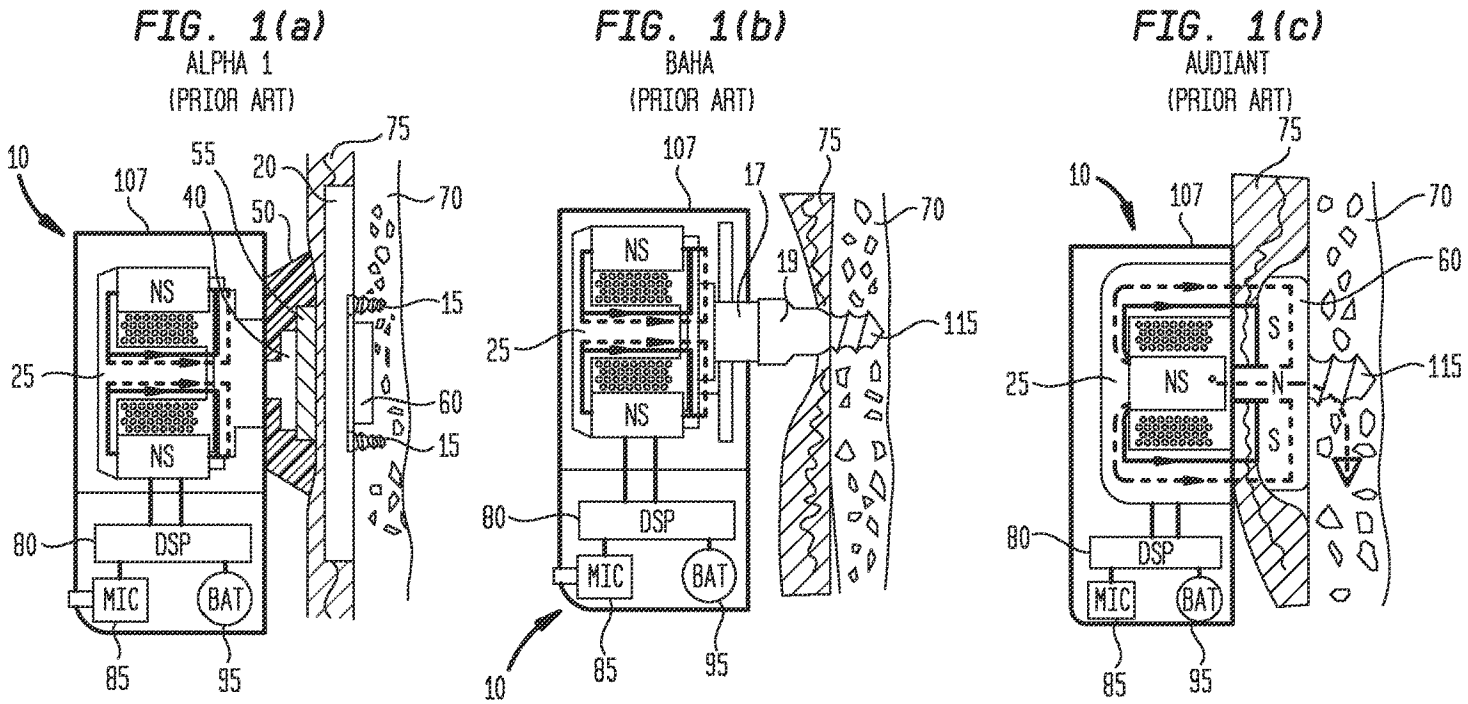
(PRIOR ART) FIG. 1(b)
(PRIOR ART) FIG. 1(c)
FIGS. 1(*a*), 1(*b*) and 1(*c*) show side cross-sectional schematic views of selected embodiments of prior art SOPHONO® ALPHA™ 1, BAHA® and AUDIANT® bone conduction hearing aids, respectively.

FIGS. 1(*a*), 1(*b*) and 1(*c*) show side cross-sectional schematic views of selected embodiments of prior art SOPHONO ALPHA 1, BAHA and AUDIANT bone conduction hearing aids, respectively. Note that FIGS. 1(*a*), 1(*b*) and 1(*c*) are not necessarily to scale.

In FIG. 1(*a*), magnetic hearing aid device 10 comprises housing 107, electromagnetic/bone conduction ("EM") transducer 25 with corresponding magnets and coils, digital signal processor ("DSP") 80, battery 95, magnetic spacer or baseplate 50, and magnetic implant or magnetic implant 20. As shown in FIGS. 1(*a*) and 3(*a*), and according to one embodiment, magnetic implant 20 comprises a frame (see, for example, FIG. 3(*a*)) formed of a biocompatible metal such as medical grade titanium that is configured to have disposed therein or have attached thereto implantable magnets or magnetic members 60. Bone screws 15 secure or affix magnetic implant 20 to skull 70, and are disposed through screw holes 23 positioned at the outward ends of arms 22 of magnetic implant frame 21 (see, for example, FIG. 3(*a*)). Magnetic members 60*a* and 60*b* are configured to couple magnetically to one or more corresponding external magnetic members or magnets 55*a* and 55*b* mounted onto or into, or otherwise forming a portion of, magnetic spacer or baseplate 50, which in turn is operably coupled to EM transducer 25 and metal disc 40. DSP 80 is configured to drive EM transducer 25, metal disk 40, and magnetic spacer or baseplate 50 in accordance with external audio signals picked up by microphone 85. DSP 80 and EM transducer 25 are powered by battery 95, which according to one embodiment may be a zinc-air battery, or which may be any other suitable type of primary or secondary (i.e., rechargeable) electrochemical cell such as an alkaline or lithium battery.

As further shown in FIG. 1(*a*), magnetic implant 20 is attached to patient's skull 70, and is separated from magnetic spacer or baseplate 50 by patient's skin 75. Hearing aid device 10 of FIG. 1(*a*) is thereby operably coupled magnetically and mechanically to magnetic implant 20 implanted in patient's skull 70, which permits the transmission of audio signals originating in DSP 80 and EM transducer 25 to the patient's inner ear via skull 70.

FIG. 1(*b*) shows another embodiment of hearing device 10, which is a BAHA® device comprising housing 107, EM transducer 25 with corresponding magnets and coils, DSP 80, battery 95, external post 17, implantable bone anchor 115, and abutment member 19. In one embodiment, and as shown in FIG. 1(*b*), implantable bone anchor 115 includes a bone screw formed of a biocompatible metal such as titanium that is configured to have disposed thereon or have attached thereto abutment member 19, which in turn may be configured to mate mechanically or magnetically with external post 17, which in turn is operably coupled to EM transducer 25. DSP 80 is configured to drive EM transducer 25 and external post 17 in accordance with external audio signals received by microphone 85. DSP 80 and EM transducer 25 are powered by battery 95, which according to one embodiment is a zinc-air battery (or any other suitable battery or electrochemical cell as described above). As shown in FIG. 1(*b*), implantable bone anchor 115 is attached to patient's skull 70, and is also attached to external post 17 through abutment member 19, either mechanically or by magnetic means. Hearing aid device 10 of FIG. 1(*b*) is thus coupled magnetically and/or mechanically to implantable bone anchor 115 implanted in patient's skull 70, thereby permitting the transmission of audio signals originating in DSP 80 and EM transducer 25 to the patient's inner ear via skull 70.

FIG. 1(*c*) shows another embodiment of hearing device 10, which is an AUDIANT®-type device, where an implantable magnetic member 60 is attached by means of implantable bone anchor 115 to patient's skull 70. Implantable bone anchor 115 includes a bone screw formed of a biocompatible metal such as titanium, and has disposed thereon or attached thereto implantable magnetic member 60, which couples magnetically through patient's skin 75 to EM transducer 25. Processor 80 is configured to drive EM transducer 25 in accordance with external audio signals received by microphone 85. Hearing aid device 10 of FIG. 1(*c*) is thus coupled magnetically to implantable bone anchor 115 implanted in patient's skull 70, thereby permitting the transmission of audio signals originating in processor 80 and EM transducer 25 to the patient's inner ear via skull 70.

Figure 2A:
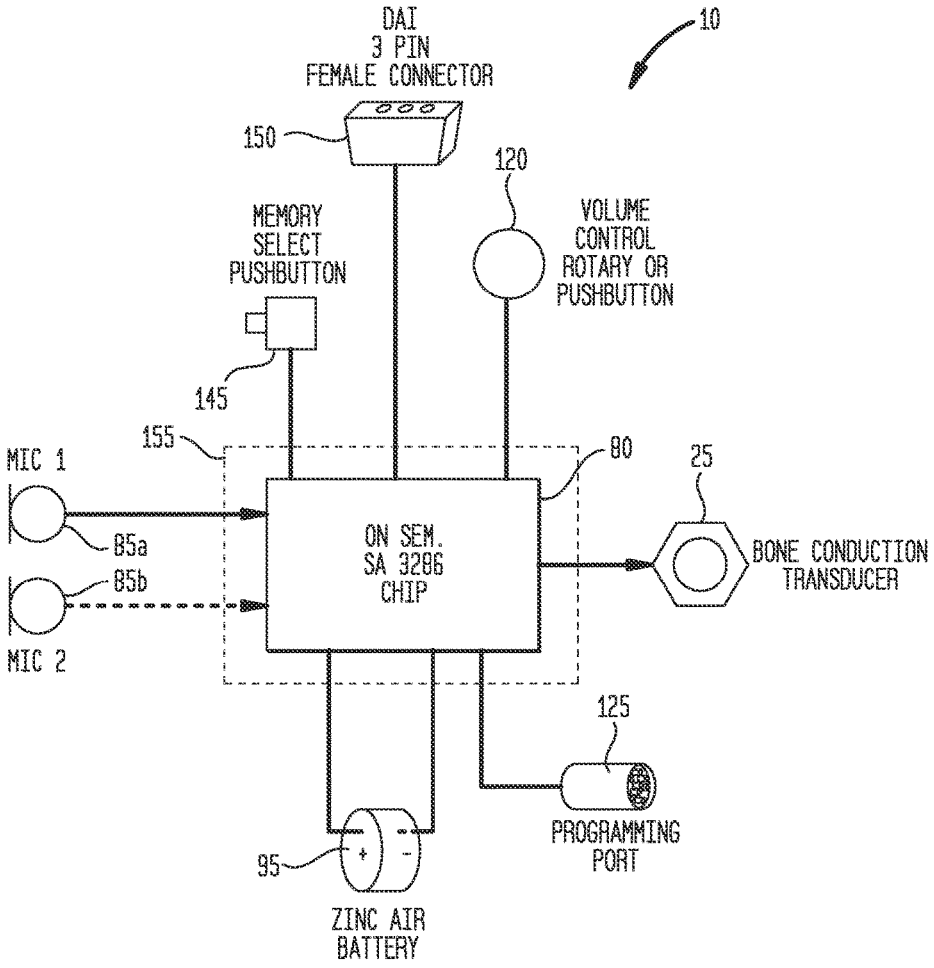
FIG. 2(a) (PRIOR ART)
FIG. 2(*a*) shows one embodiment of a prior art functional electronic and electrical block diagram of hearing aid or device 10 shown in FIGS. 1(*a*) and 3(*b*)
Figure 2B:
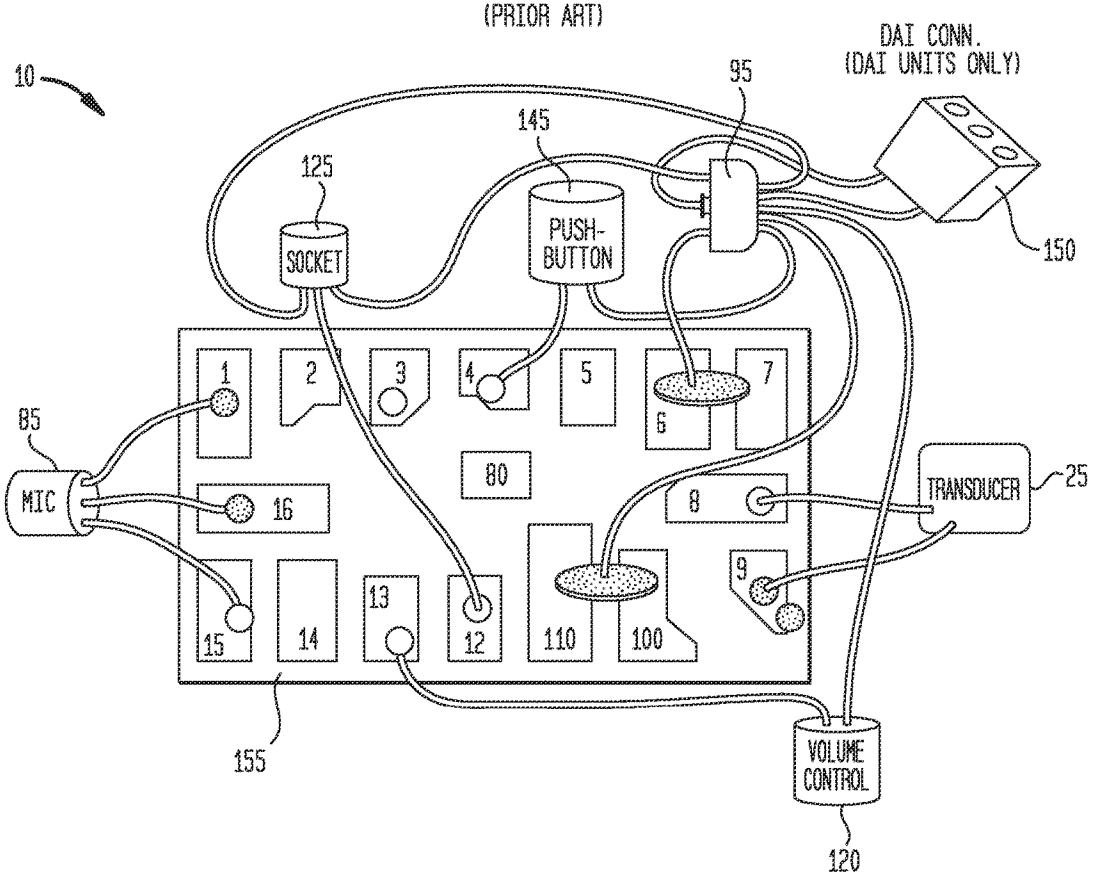
FIG. 2(b) (PRIOR ART)

FIG. 2(*a*) shows one embodiment of a prior art functional electronic and electrical block diagram of hearing aid or device 10 shown in FIGS. 1(*a*) and 2(*b*). In the block diagram of FIG. 2(*a*), and according to one embodiment, processor 80 is a SOUND DESIGN TECHNOLOGIES® SA3286 INSPIRA EXTREME® DIGITAL DSP, for which data sheet 48550-2 dated March 2009, a copy of which may be found in the file history of parent U.S. application Ser. No. 14/288,100, filed May 27, 2014. The audio processor for the SOPHONO ALPHA 1™ hearing aid is centered around DSP chip 80, which provides programmable signal processing functionality. Signal processing may be customized by computer software which communicates with the SOPHONO ALPHA 1 through programming port 125. According to one embodiment, the system is powered by a standard zinc air battery 95 (i.e., hearing aid battery), although other types of batteries may be employed. The SOPHONO ALPHA 1 hearing aid detects acoustic signals using dual miniature microphones 85*a* and 85*b* (one or both of which may be employed). The SA 3286 chip 80 supports directional audio processing with first and second microphones 85*a* and 85*b* to enable directional processing of signals. Direct Audio Input (DAI) connector 150 allows connection of accessories which provide an audio signal in addition to or in lieu of the microphone signal. The most common usage of the DAI connector is in conjunction with FM systems. An FM receiver may be plugged into DAI connector 150. An FM transmitter can be worn, for example, by a teacher in a classroom to ensure the teacher is heard clearly by a student wearing hearing aid or device 10 and the corresponding FM receiver. Other DAI accessories include an adapter for a music player, a telecoil, or a Bluetooth phone accessory. According to one embodiment, processor 80 or SA 3286 80 has 4 available program memories, allowing a hearing health professional to customize each of 4 programs for different listening situations. Memory Select Pushbutton 145 allows the user to choose from the activated memories. This might include special frequency adjustments for noisy situations, a program which is directional, or a program which uses the DAI input.

FIG. 2(*b*) shows one embodiment of a prior art wiring diagram for a SOPHONO ALPHA 1 hearing aid manufactured using the foregoing SA3286 DSP 80. Note that the various embodiments of hearing device 10 are not limited to the use of a SA3286 DSP 80, and that any other suitable CPU, processor, controller or computing device 80 may be used. According to one embodiment, processor 80 is mounted on a printed circuit board 155 disposed within housing 107 of hearing device 10.

In some embodiments, microphone 85 incorporated into hearing device 10 is an 8010T microphone manufactured by SONION®, for which data sheet 3800-3016007, Version 1 dated December, 2007, a copy of which may be found in the file history of parent U.S. application Ser. No. 14/288,100, filed May 27, 2014. In the various embodiments of hearing aids claimed herein, other suitable types of microphones, including other types of capacitive microphones, may be employed. In still further embodiments of hearing aids claimed herein, electromagnetic transducer 25 incorporated into hearing device 10 is a VKH3391 W transducer manufactured by BMH-Tech® of Austria, a copy of which may also be found in the file history of parent U.S. application Ser. No. 14/288,100, filed May 27, 2014. Other types of suitable EM or other types of transducers may also be used.

Figure 3C:
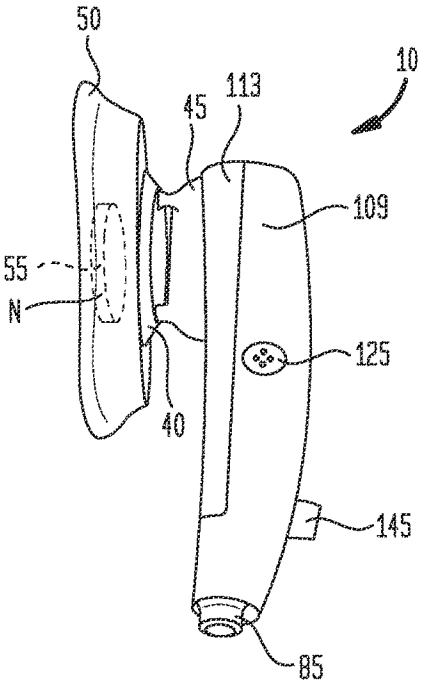
FIG. 3(c) (PRIOR ART)
FIG. 3(*a*) shows one embodiment of prior art magnetic implant 20 according to FIG. 1(*a*)
Figure 3B:
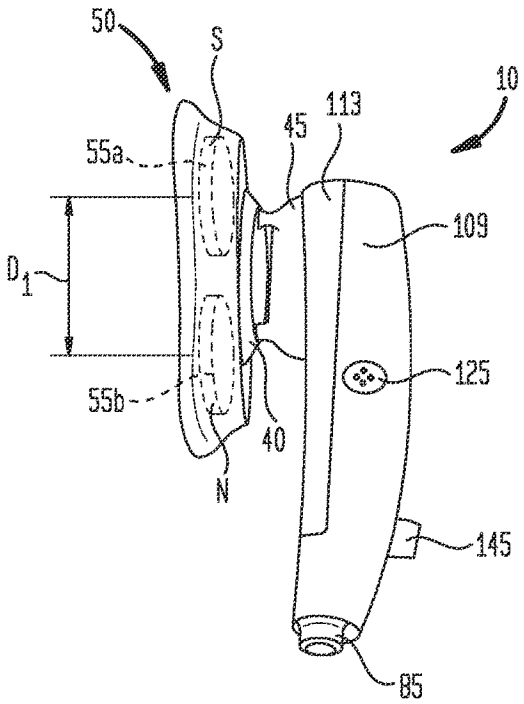
FIG. 3(b) (PRIOR ART)
Figure 3A:
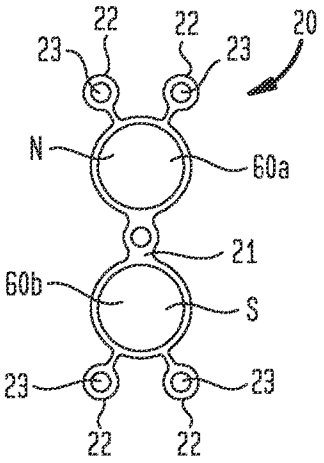
FIG. 3(a) (PRIOR ART)

FIGS. 3(*a*), 3(*b*) and 3(*c*) show bone conduction hearing device(s) (BCHD) 10 and magnetic implant 20 in accordance with FIG. 1(*a*), where implantable frame 21 of magnetic implant 20 has disposed thereon or therein implantable magnetic members 60*a* and 60*b* (see FIGS. 3(*a*) and 3(*b*)), and where magnetic spacer or baseplate 50 of hearing device 10 has magnetic members 55*a* and 55*b* disposed therein (see FIG. 3(*b*)). Two magnets 60*a* and 60*b* of magnetic implant 20 of FIG. 3(*a*) permit hearing device 10 and magnetic spacer or baseplate 50 to be placed in a single position on patient's skull 70, with respective opposing pairs of north and south poles of magnetic members 55*a* and 60*a*, and 55*b* and 60*b*, appropriately aligned with respect to one another to permit a sufficient degree of magnetic coupling to be achieved between magnetic spacer or baseplate 50 and magnetic implant 20 (see FIG. 3(*b*)). As shown in FIG. 1(*a*), magnetic implant 20 is preferably configured to be affixed to skull 70 under patient's skin 75. In one aspect, affixation of magnetic implant 20 to skull 75 is by direct means, such as by screws 15.

Referring to FIG. 3(*b*), there is shown a SOPHONO® ALPHA 1 hearing device 10 configured to operate in accordance with magnetic implant 20 of FIG. 3(*a*). As shown, hearing device 10 of FIG. 3(*b*) comprises upper housing 109, lower housing 113, magnetic spacer or baseplate 50, external magnets 55*a* and 55*b* disposed within spacer or baseplate 50, EM transducer coupler or connector 45, metal disk 40 coupled to EM transducer 25 via coupler 45, spacer or baseplate 50 magnetically coupled to disk 40, programming port/socket 125, program switch 145, and microphone 85. Not shown in FIG. 3(*b*) are various other aspects of the embodiment of hearing device 10, such as volume control 120, battery compartment 130, battery door 135, battery contacts 140, direct audio input (DAI) 150, and hearing aid circuit board 155 upon which various components are mounted, such as processor 80.

Continuing to refer to FIGS. 3(*a*) and 3(*b*), frame 22 of magnetic implant 20 holds a pair of magnets 60*a* and 60*b* that correspond to magnets 55*a* and 55*b* included in spacer or baseplate 50 shown in FIG. 3(*b*). The south (S) pole and north (N) poles of magnets 55*a* and 55*b* are respectively configured in spacer or baseplate 50 such that the south pole of magnet 55*a* is intended to overlie and magnetically couple to the north pole of magnet 60*a*, and such that the north pole of magnet 55*b* is intended to overlie and magnetically couple to the south pole of magnet 60*b*. This arrangement and configuration of magnets 55*a*, 55*b*, 60*a* and 60*b* is intended permit the magnetic forces required to hold hearing device 10 onto a patient's head to be spread out or dispersed over a relatively wide surface area of the patient's hair and/or skin 75, and thereby prevent irritation of soreness that might otherwise occur if such magnetic forces were spread out over a smaller or more narrow surface area. In the embodiment shown in FIG. 3(*a*), frame 22 and magnetic implant 20 are configured for affixation to patient's skull 70 by means of screws 15, which are placed through screw recesses or holes 23. FIG. 3(*c*) shows an embodiment of hearing device 10 configured to operate in conjunction with a single magnet 60 disposed in magnetic implant 20 per FIG. 1(*a*).

Referring now to FIGS. 4 through 11(*b*), there are shown various embodiments and views of hearing device 10 having improved acoustic isolation between one or more microphones 85 and transducer 25. It has been discovered that sounds generated by electromagnetic transducer 25 can be undesirably sensed or picked up by microphone 85, which can affect the fidelity or accuracy of the sounds delivered to the patient's cochlea. In particular, undesirable feedback between transducer 25 and microphones 85 has been discovered to occur in at least some of the prior art versions of hearing device 10 described above. Such feedback can adversely affect the fidelity and accuracy of the sounds delivered to a patient by hearing device 10. Described below are various means and methods of solving this problem, and of better acoustically isolating one or more microphones 85 from transducer 25.

Before describing the various embodiments of hearing device 10 that provide improved acoustic isolation between microphone(s) 85 and transducer 25, note that processor 80 shown in FIG. 1(*b*) is a DSP or digital signal processor. After having read and understood the present specification, however, those skilled in the art will understand that hearing device 10 incorporating the various acoustic isolation means and methods described below may be employed in conjunction with processors 80 other than, or in addition to, a DSP. Such processors 80 include, but are not limited to, CPUs, processors, microprocessors, controllers, microcontrollers, application specific integrated circuits (ASICs) and the like. Such processors 80 are programmed and configured to process the ambient external audio signals sensed by picked up by microphone 85, and further are programmed to drive transducer 25 in accordance with the sensed ambient external audio signals. Moreover, more than one such processor 80 may be employed in hearing device 10 to accomplish such functionality, where the processors are operably connected to one another. Electrical or electronic circuitry in addition to that shown in FIGS. 1(*a*) through 2(*b*) may also be employed in hearing device 10, such as amplifiers, filters, and wireless or hardwired communication circuits that permit hearing device 10 to communicate with or be programmed by external devices.

Microphones 85 or other types of sound-detecting or receiving transducers in addition to the SONION microphone described above may be employed in the various embodiments of hearing device 10, including, but not limited to, receivers, telecoils (both active and passive), noise cancelling microphones, and vibration sensors. Such receiving transducers 85 are referred to generically herein as "microphones." Sound generation transducers 25 other than the VKH3391 W EM transducer described above may also be employed in hearing device 10, including, but not limited to, suitable piezoelectric transducers.

Figure 4:
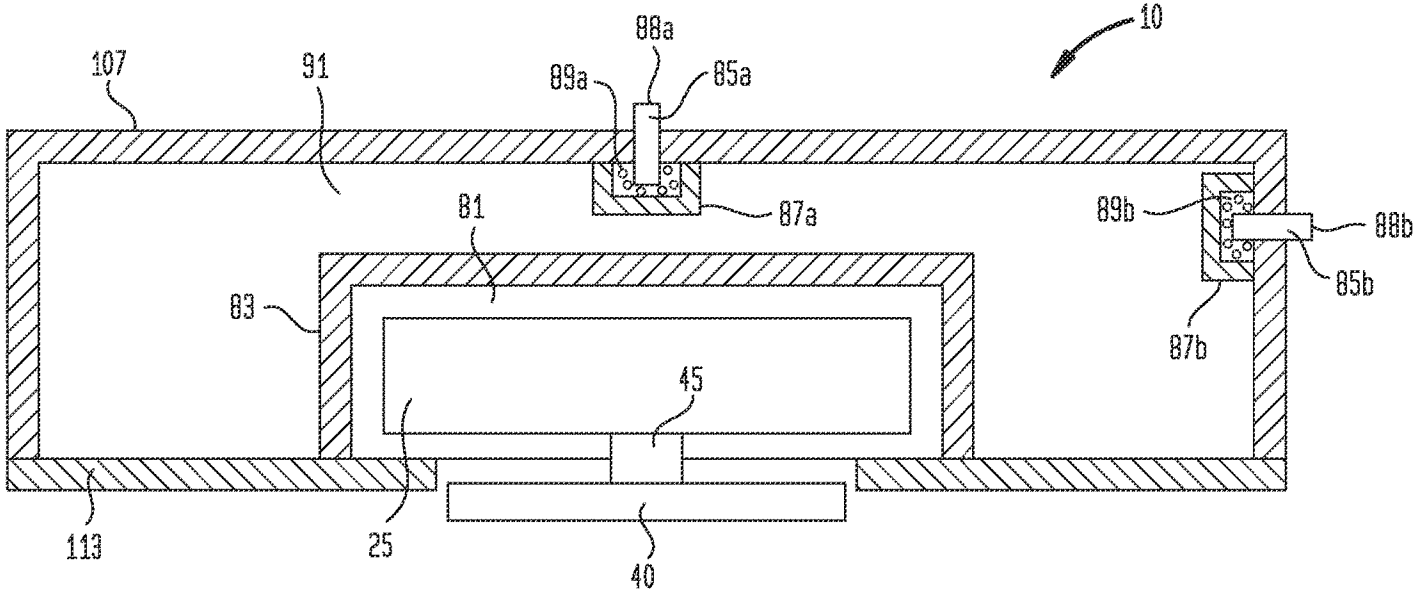
FIG. 4 shows a cross-sectional view of one embodiment of hearing aid having improved acoustic isolation between one or more microphones and transducer.

FIG. 4 shows a cross-sectional view of one embodiment of hearing device 10 where only some portions of hearing device 10 are shown, including some relating to providing one or more acoustic barriers or isolating means between microphones 85*a* and 85*b*, and transducer 25 in hearing device 10. In FIG. 4, main hearing aid housing 107 includes therein or has attached thereto transducer 25 and microphones 85*a* and 85*b*. Metal disc 40 is operably connected to transducer 25 via coupler 45, and permits hearing device 10 to be operably connected by magnetic means to underlying magnetic spacer or baseplate 50*a* for the delivery of sound generated by transducer 25 to the patient's cochlear by bone conduction, disk 40 being formed of a ferromagnetic material such as steel. In the embodiment shown in FIG. 4, a transducer acoustic barrier or shield 83 (or transducer encapsulation compartment 83) is provided that surrounds transducer 25, and that is configured to block, absorb and/or attenuate sounds originating from transducer 25 that might otherwise enter space or volume 85, which is in proximity to microphones 85*a* and 85*b*. During the process of generating sound, transducer 25 vibrates and shakes inside transducer encapsulation compartment 83 as it delivers sound to disk 40, magnetic spacer 50 and the patient's cochlea.

Transducer encapsulation compartment 83 prevents, attenuates, blocks, reduces, minimizes, and/or substantially eliminates the propagation of audio signals between transducer 25 and microphones 85*a* and 85*b*. In one embodiment, transducer encapsulation compartment 83 is configured to absorb and/or partially absorb audio signals originating from transducer 25, and comprises or is formed of, by way of non-limiting example, one or more of a poro-elastic material, a porous material, a foam, a polyurethane foam, polymer microparticles, an inorganic polymeric foam, a polyurethane foam, a smart foam (e.g., a foam which operates passively at higher frequencies and that also includes an active input of a PVDF or polyvinylidene fluoride element driven by an oscillating electrical input, which is effective at lower frequencies), a cellular porous sound absorbing material, cellular melamine, a granular porous sound absorbing material, a fibrous porous sound absorbing material, a closed-cell metal foam, a metal foam, a gel, an aerogel, or any other suitable sound-absorbing or attenuating material.

Transducer encapsulation compartment 83 may also be formed of a flexural sound absorbing material, or of a resonant sound absorbing material, that is configured to damp and reflect sound waves incident thereon. Such materials are generally non-porous elastic materials configured to flex due to excitation from sound energy, and thereby dissipate the sound energy incident thereon, and/or to reflect some portion of the sound energy incident thereon.

In FIG. 4, microphones 85*a* and 85*b* are shown as being mounted or attached to main housing 107. Two microphones 85*a* and 85*b* are shown as being disposed in different locations on main housing 107, one on the top of main housing 107 (microphone 85*a*) and one on the side of main housing 107 (microphone 85*b*); other locations for microphones 85*a* and/or 85*b* are also contemplated. In the various embodiments described herein, only one of such microphones may be employed in hearing device 10, or additional microphone(s) may be employed. In FIG. 4, microphones 85*a* and 85*b* are shown as being at least substantially and preferably fully surrounded by microphone encapsulation compartments 87*a* and 87*b*, respectively, which according to various embodiments may or may not include sound attenuating or absorbing materials 89*a* and 89*b*. Alternatively, microphones 85*a* and 85*b* may be potted in or surrounded only by sound reflecting, sound dissipating, sound attenuating, sound deadening and/or sound absorbing materials 89*a* and 89*b*.

In one embodiment, microphone encapsulation compartments 87*a* and 87*b* are configured to absorb and/or partially absorb audio signals originating from transducer 25, and comprise or are formed of, by way of non-limiting example, one or more of a poro-elastic material, a porous material, a foam, a polyurethane foam, polymer microparticles, an inorganic polymeric foam, a polyurethane foam, a cellular porous sound absorbing material, cellular melamine, a granular porous sound absorbing material, a fibrous porous sound absorbing material, a closed-cell metal foam, a metal foam, a gel, an aerogel, or any other suitable sound-absorbing or attenuating material. The same or similar materials may be employed in sound attenuating or absorbing materials 89*a* and 89*b*.

Microphone encapsulation compartments 87*a* and 87*b* may also be formed of flexural sound absorbing materials, or of resonant sound absorbing materials, that are configured to damp and reflect sound waves incident thereon. Such materials are generally non-porous elastic materials configured to flex due to excitation from sound energy, and thereby dissipate the sound energy incident thereon, and/or to reflect some portion of the sound energy incident thereon.

In some embodiments, no sound attenuating or absorbing materials, flexural sound absorbing materials, or resonant sound absorbing materials 89*a* and 89*b* are disposed between microphone encapsulation compartments 87*a* and 87*b* and respective microphones 85*a* and 85*b* associated therewith.

In other embodiments, microphones 85*a* and 85*b* are directional microphones configured to selectively sense external audio signals in preference to undesired audio signals originating from transducer 25.

In further embodiments, one or more noise cancellation microphones (not shown in FIG. 4) are provided inside main housing 107, and are positioned and configured to sense undesired audio signals originating from transducer 25. Output signals generated by the one or more noise cancellation microphones are routed to processor 80, where adaptive filtering or other suitable digital signal processing techniques known to those skilled in the art (e.g., adaptive feedback reduction algorithms using adaptive gain reduction, notch filtering, and phase cancellation strategies) are employed to remove or cancel major portions of undesired transducer/microphone feedback noise from the sound delivered that is to the patient's cochlea by transducer 25 and hearing device 10.

In FIG. 4, in some embodiments only a selected one or more of transducer encapsulation compartment 83, microphone encapsulation compartments 87*a* and 87*b*, and sound attenuating or absorbing materials, flexural sound absorbing materials, or resonant sound absorbing materials 89*a* and 89*b* are employed in hearing aid or device 10.

Figure 5:
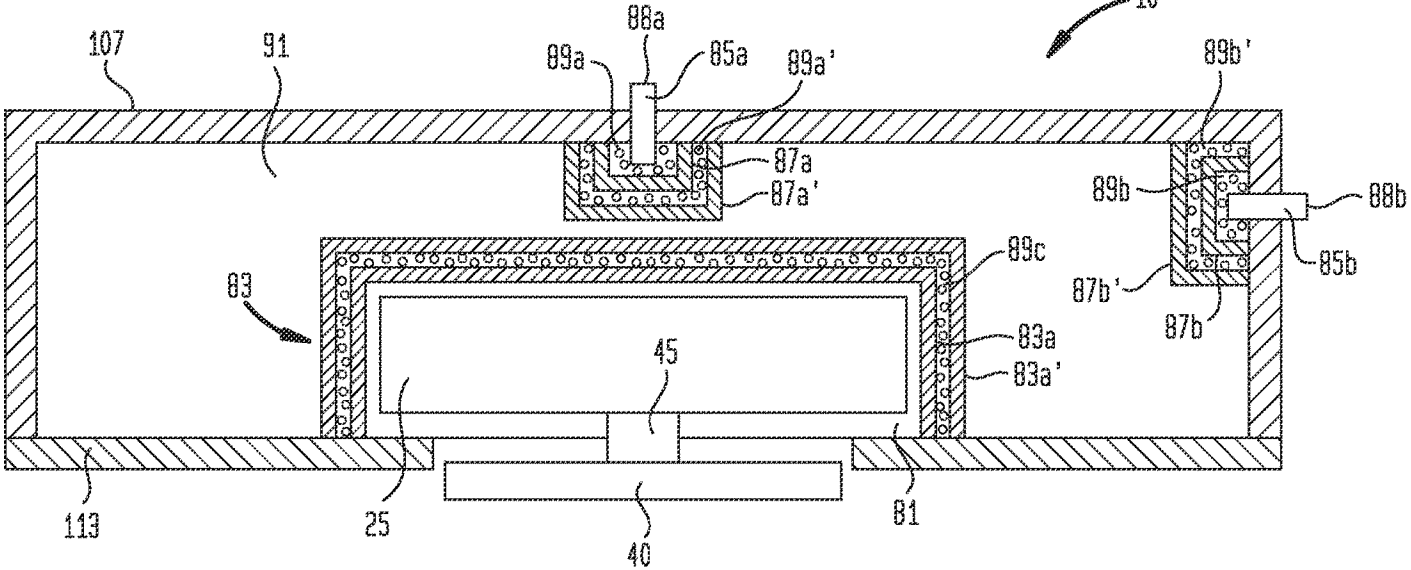
FIG. 5 shows a cross-sectional view of another embodiment of hearing aid having improved acoustic isolation between one or more microphones and transducer.

Referring now to FIG. 5, there is shown a cross-sectional view of another embodiment of hearing aid or device 10 where only some portions of hearing device 10 are shown, including some relating to providing one or more acoustic barriers or isolating means between microphones 85*a* and 85*b* and transducer 25 in hearing device 10. In the embodiment shown in FIG. 5, transducer encapsulation compartment 83 comprises multiple layers or components, namely inner transducer encapsulation compartment 83*a*, sound attenuating or absorbing material, flexural sound absorbing material, or resonant sound absorbing material 89*c*, and outer transducer encapsulation compartment 83*a*'. Such a configuration of nested transducer encapsulation compartments 83*a* and 83*a*' separated by sound attenuating or absorbing material 89*c* results in increased deadening or attenuation of undesired sound originating from transducer 25 that might otherwise enter volume or space 87 and adversely affect the performance of microphones 85*a* and 85*b*. In some embodiments, and by way of non-limiting example, transducer encapsulation compartment 83 of FIG. 5 is manufactured by sandwiching sound attenuating or absorbing material, flexural sound absorbing material, or resonant sound absorbing material 89*c* between overmolded layers of a suitable polymeric or other material.

In FIG. 5, and in a similar manner, one or more of microphones 85*a* and 85*b* may be at least substantially and preferably completely surrounded by nested inner and outer microphone encapsulation compartments 87*a* and 87*a*', and 87*b* and 87*b*', respectively, which in turn are separated by sound attenuating or absorbing materials, flexural sound absorbing materials, or resonant sound absorbing materials 89*a*' and 89*b*', respectively. Such a configuration of nested microphone encapsulation compartments 87*a*/87*a*' and 87*b*/87*b*' separated by sound attenuating or absorbing materials 89*a*' and 89*b*' results in increased deadening or attenuation of undesired sound originating from transducer 25 impinging upon microphones 85*a* and 85*b* and thereby adversely affecting the performance of such microphones. In some embodiments, and by way of non-limiting example, microphone encapsulation compartments 87*a*/87*a*' and 87*b*/87*b*' are manufactured by sandwiching sound attenuating or absorbing material, flexural sound absorbing material, or resonant sound absorbing materials 89*a*' and 89*b*' between overmolded layers of a suitable polymeric or other material.

In FIG. 5, in some embodiments only a selected one or more of transducer encapsulation compartment 83, microphone encapsulation compartment 87*a*, microphone encapsulation compartment 87*a*', microphone encapsulation compartment 87*b*, microphone encapsulation compartment 87*b*', and sound attenuating or absorbing material, flexural sound absorbing material, or resonant sound absorbing material 89*a*, 89*a*', 89*b*, and 89*b*' are employed in hearing device 10.

Note further that in some embodiments of transducer encapsulation compartment 83 and microphone encapsulation compartments 87*a*/87*a*' and 87*b*/87*b*' shown in FIG. 5 may also be modified such that air, a sound-deadening gas, a sound-deadening liquid, a sound-deadening gel, or a vacuum is disposed between the nested inner and outer encapsulation compartments to enhance the sound-attenuating properties of such encapsulation compartments. Moreover, a vacuum or suitable gas may be disposed in volume or space 81 of transducer encapsulation compartment 83, where compartment 83 is hermetically sealed, thereby to reduce or attenuate the propagation of unwanted transducer audio signals into volume or space 85 of main housing 107.

Referring now to FIGS. 4 and 5, any one or more of transducer encapsulation compartment 83, microphone encapsulation compartments 87, 87*a*, 87*a*', 87*b* and 87*b*' may be dimensioned, configured and formed of appropriate materials such that such compartments are tuned to resonate, and therefore dissipate sound energy, at peak frequencies associated with noise generated by transducer 25.

Figures 6A, 6B, 6C:
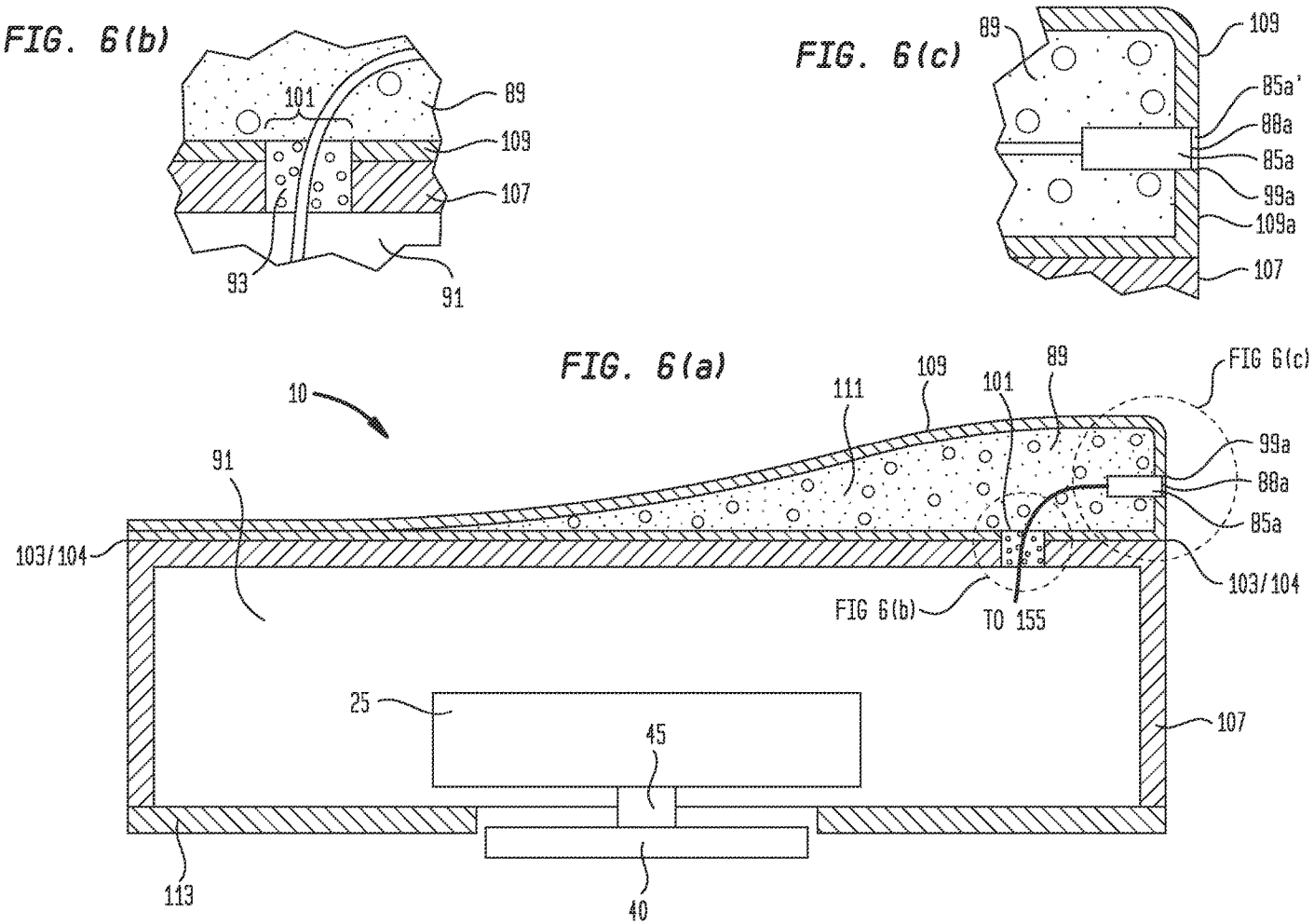
FIGS. 6(*a*), 6(*b*) and 6(*c*) show cross-sectional views of another embodiment of hearing aid or device 10 having improved acoustic isolation between one or more microphones 85 and transducer 25.

FIGS. 6(*a*) through 8 show another embodiment of hearing device 10. Referring first to FIGS. 6(*a*), 6(*b*) and 6(*c*), there are shown cross-sectional views of various portions of one embodiment of hearing aid or device 10. Only some portions of hearing device 10 are shown in FIGS. 6(*a*) through 6(*c*), including some relating to providing one or more acoustic barriers or isolating means between microphone 85*a* and transducer 25. FIG. 6(*a*) is a cross-sectional view of hearing device 10 without baseplate 50 coupled thereto. FIGS. 6(*b*) and 6(*c*) show enlarged portions of hearing device 10 relating to portions disposed near hole 101 and portions disposed near microphone 85*a*.

In the embodiment of hearing aid or device 10 shown in FIG. 6(*a*), upper housing 109 comprises microphone 85*a* mounted in recess or hole 99*a* disposed through the sidewall of upper housing 89, external end 88*a* of microphone 85*a*, sound attenuating or absorbing material 89 (which may also be a flexural sound absorbing material or resonant sound absorbing material), hole or passageway 101, and seal or sealing material 93 disposed in hole 101. In the embodiment shown in FIGS. 6(*a*) through 6(*c*), first compartment 111 is formed by upper housing 109, and second compartment 91 is formed by main housing 107 in conjunction with bottom housing 113. Microphone 85*a* is disposed within first compartment 111, and transducer 25 is disposed within second compartment 91. In the embodiment of hearing device 10 shown in FIG. 6(*a*), seams 103 and 104 separate upper housing 109 from main housing 107, and depending on the particular means and configuration by which upper housing 109 is joined or attached to main housing 107, seams 103 and 104 may also separate first compartment 111 from second compartment 91, or portions thereof. Hole 101 is disposed through a bottom portion of upper housing 109 and a top portion of main housing 107, and permits electrical wire 97 to pass from the first compartment into the second compartment for connection to circuit board 155 (not shown in FIG. 6(*a*)). Hole 101 is shown in FIGS. 6(*a*) and 6(*b*) as being filled with seal, acoustic seal, or sealing material 93.

It has been discovered that hole 101, seams 103 and 104, and any other holes, seams, breeches, leaks or acoustic passageways disposed between first compartment 111 and second compartment 91 can permit the ingress or introduction of undesired acoustic signals emanating from transducer 25 located in second compartment 91 into first compartment 111 through such holes, seams, breeches, holes, leaks or acoustic passageways. These undesired acoustic signals can substantially increase the amount of feedback occurring between transducer 25 and microphone(s) 85, and thereby decrease significantly the fidelity of sound generated by hearing device 10 and transmitted to the patient. It has also been discovered that the amount of such feedback can be dramatically reduced by placing seals or sealing materials 93 in such holes, seams, breeches, leaks or acoustic passageways 101/103/104 disposed between first compartment 111 and second compartment 91, where seals 93 block, prevent or inhibit the transmission of undesired acoustic signals from second compartment 91 to first compartment 111. Seals 93 between the first and second compartments may also be formed or effected with suitable adhesives, glues, silicones, plastics, thermoplastics, epoxies, ultrasonic welds, or any other suitable materials or processes that those skilled in the art will now understand after having read and understood the present specification, drawings and claims.

In FIGS. 6(*a*) and 6(*c*), hole or recess 99*a* extends between first compartment 111 and an external surface of hearing device 10 or upper housing 109. Hole or cavity 99*a* is configured to receive external end 88*a* of microphone 85*a* therein. It has been discovered that by positioning external end 88*a* of microphone 85*a* flush with, or slightly inwardly from, the external surface of upper housing 109, undesired feedback between transducer 25 and microphone 85*a* is also reduced. It is believed such reduced feedback is due to external end 88*a* not being positioned in free air outside upper housing 109, and therefore not receiving or even amplifying through its own motion and interaction with undesired acoustic signals originating from transducer 25 or baseplate 50 that propagate around the external surfaces of hearing device 10. External end 88*a* and microphone 85*a* are preferably glued or sealed to at least portions of recess 99*a*.

In FIGS. 6(*a*) through 6(*c*), first compartment 111 or portions thereof may be filled or partially filled with material 93, which according to some embodiments may be one or more of a sound attenuating or absorbing material, a flexural sound absorbing material, a resonant sound absorbing material, a poro-elastic material, a porous material, a foam, a polyurethane foam, polymer microparticles, an inorganic polymeric foam, a polyurethane foam, a smart foam, a cellular porous sound absorbing material, cellular melamine, a granular porous sound absorbing material, a fibrous porous sound absorbing material, a closed-cell metal foam, a metal foam, a gel, and an aerogel. Material 93 is likewise configured to help effect a reduction in feedback between transducer 25 and microphone(s) 85*a*. Material 93 may also be employed in second compartment 91 for the same purpose. Material 93, whether dispose din first compartment 111 or second compartment 91, may also comprise one or more of a flexural sound absorbing material and a resonant sound absorbing material configured to damp or reflect sound waves generated by the transducer that are incident thereon. Material 93 may also be a sound attenuating or absorbing potting material employed to fill or partially fill first compartment 111 or second compartment 91, also configured for the purpose of reducing feedback. Noise cancellation microphones may also be disposed inside hearing device 10 to further reduce feedback.

Figure 7:
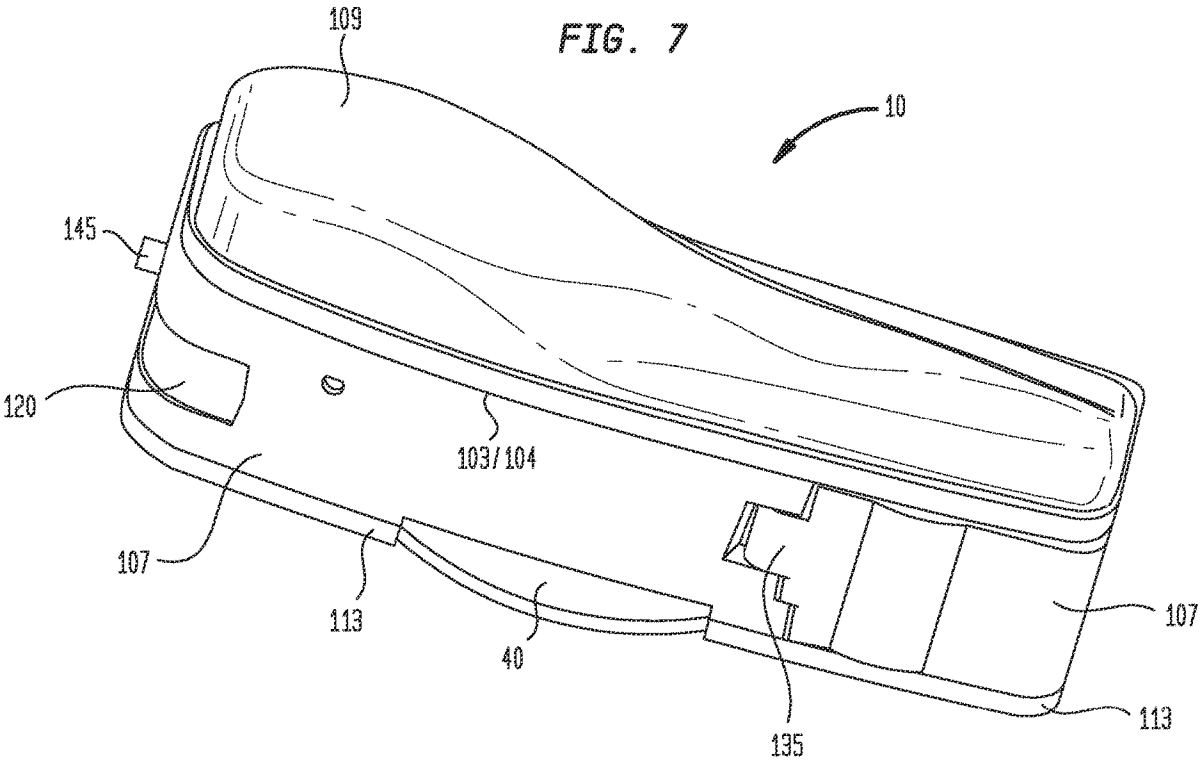
FIGS. 7 and 8 show top perspective side and end views of the embodiment of hearing aid or device 10 shown in FIG. 6(*a*)
Figure 8:
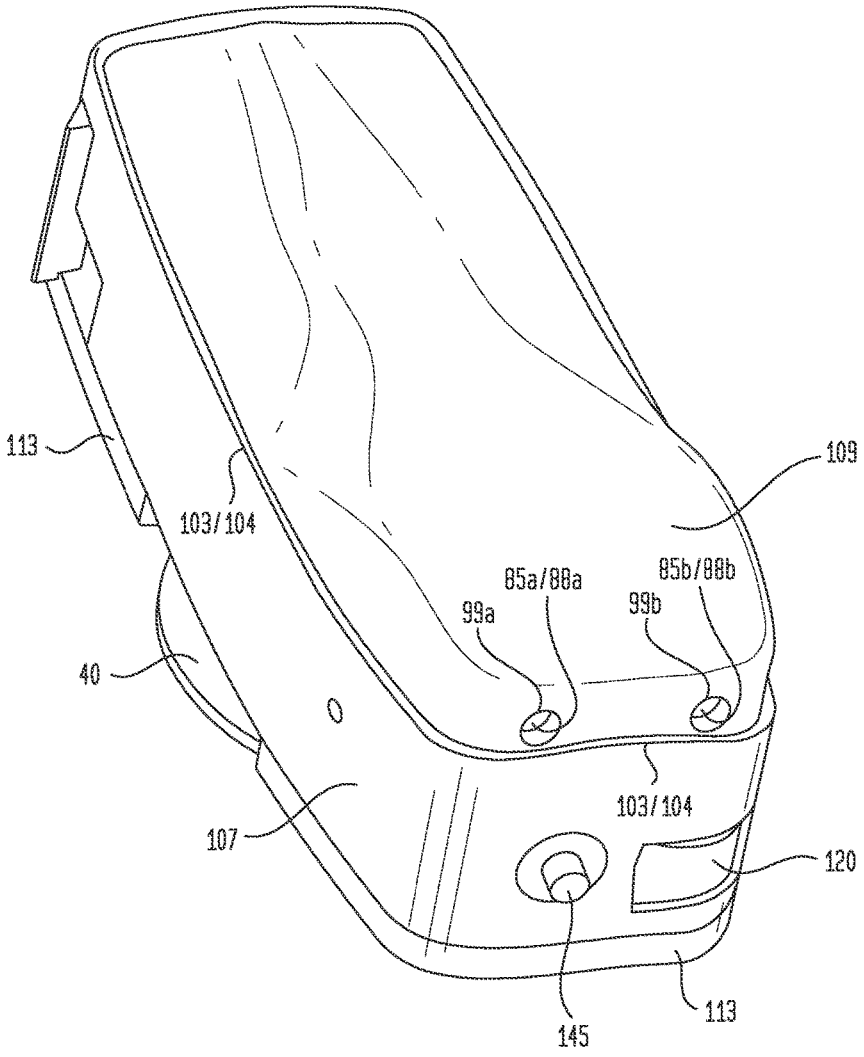

FIG. 7 shows a top perspective side view of hearing device 10 of FIG. 6(*a*). FIG. 8 shows a top perspective end view of hearing device 10 of FIG. 6(*a*).

Figure 9A:
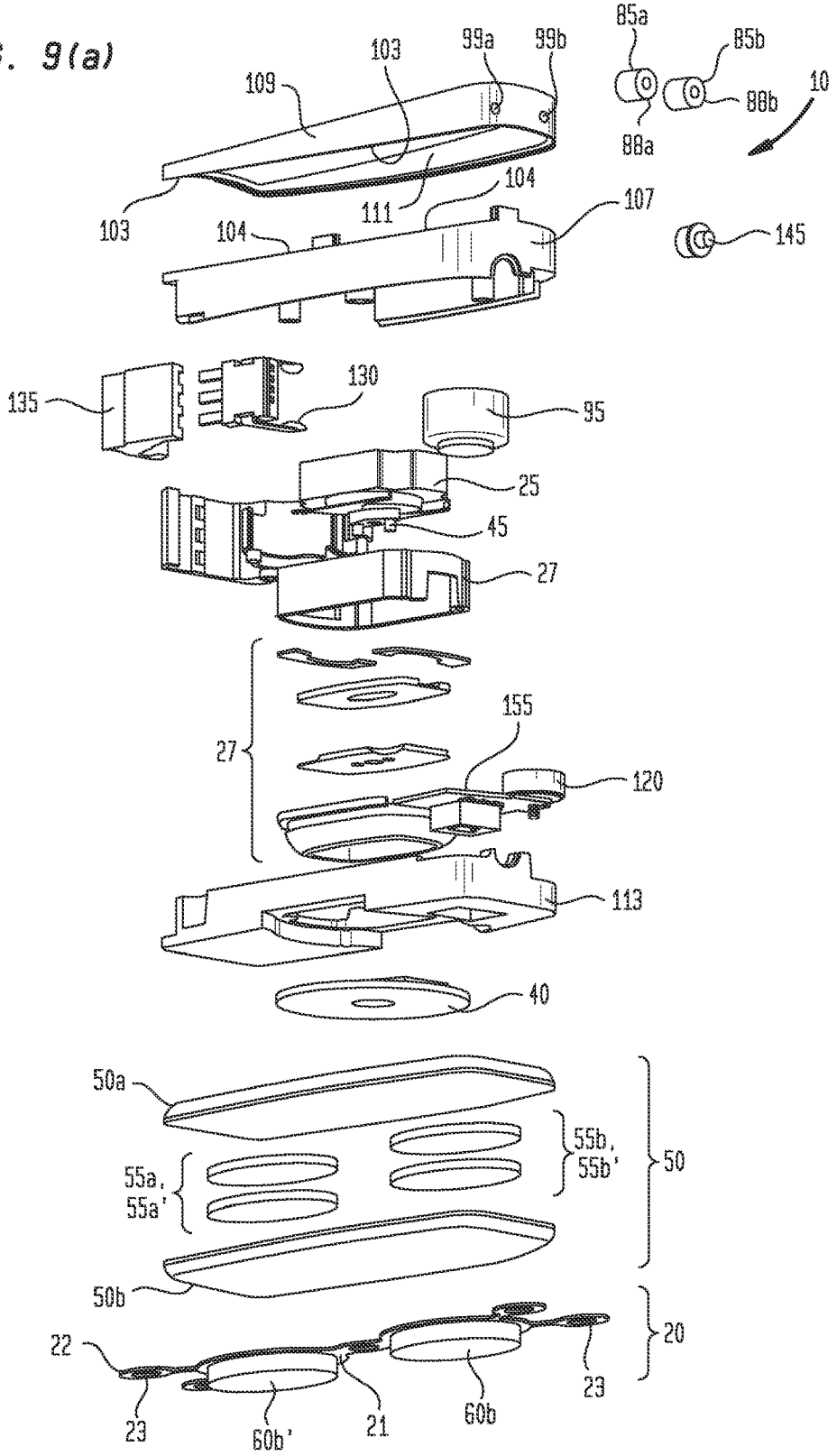
FIGS. 9(*a*) and 9(*b*) show, respectively, bottom side perspective exploded and top side perspective assembled partial cut-away views of another embodiment of hearing aid.
Figure 9B:
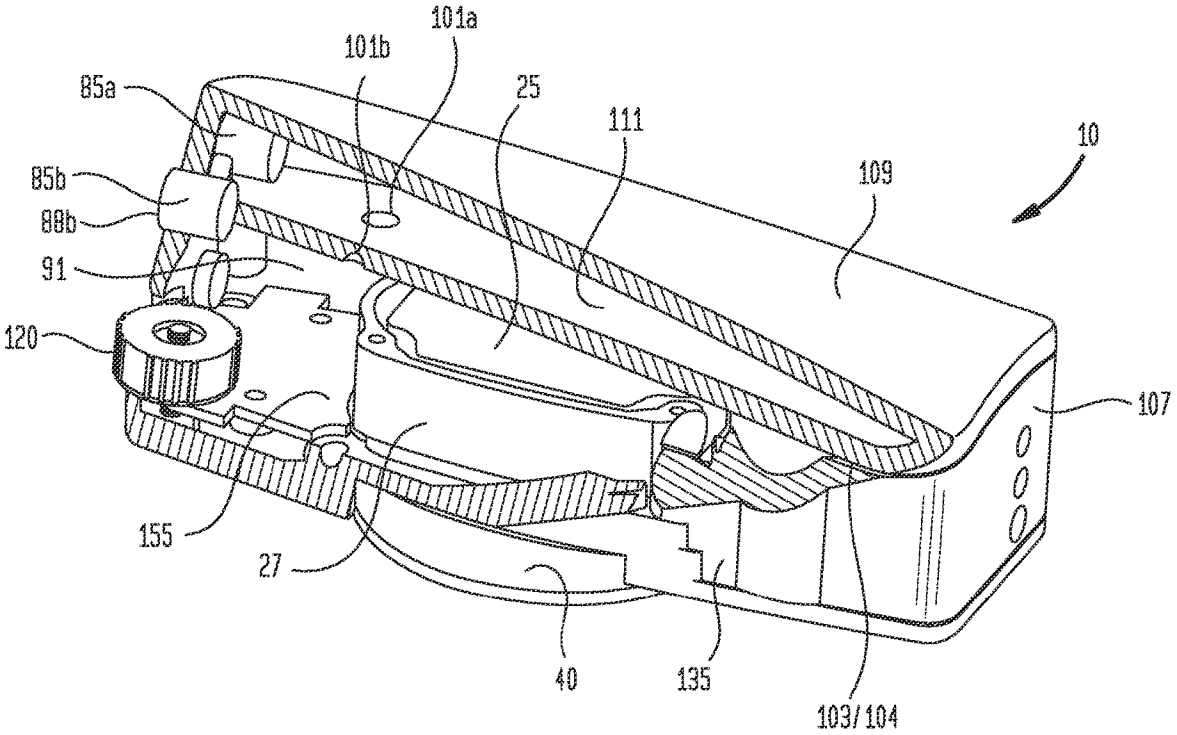
Figure 10A:
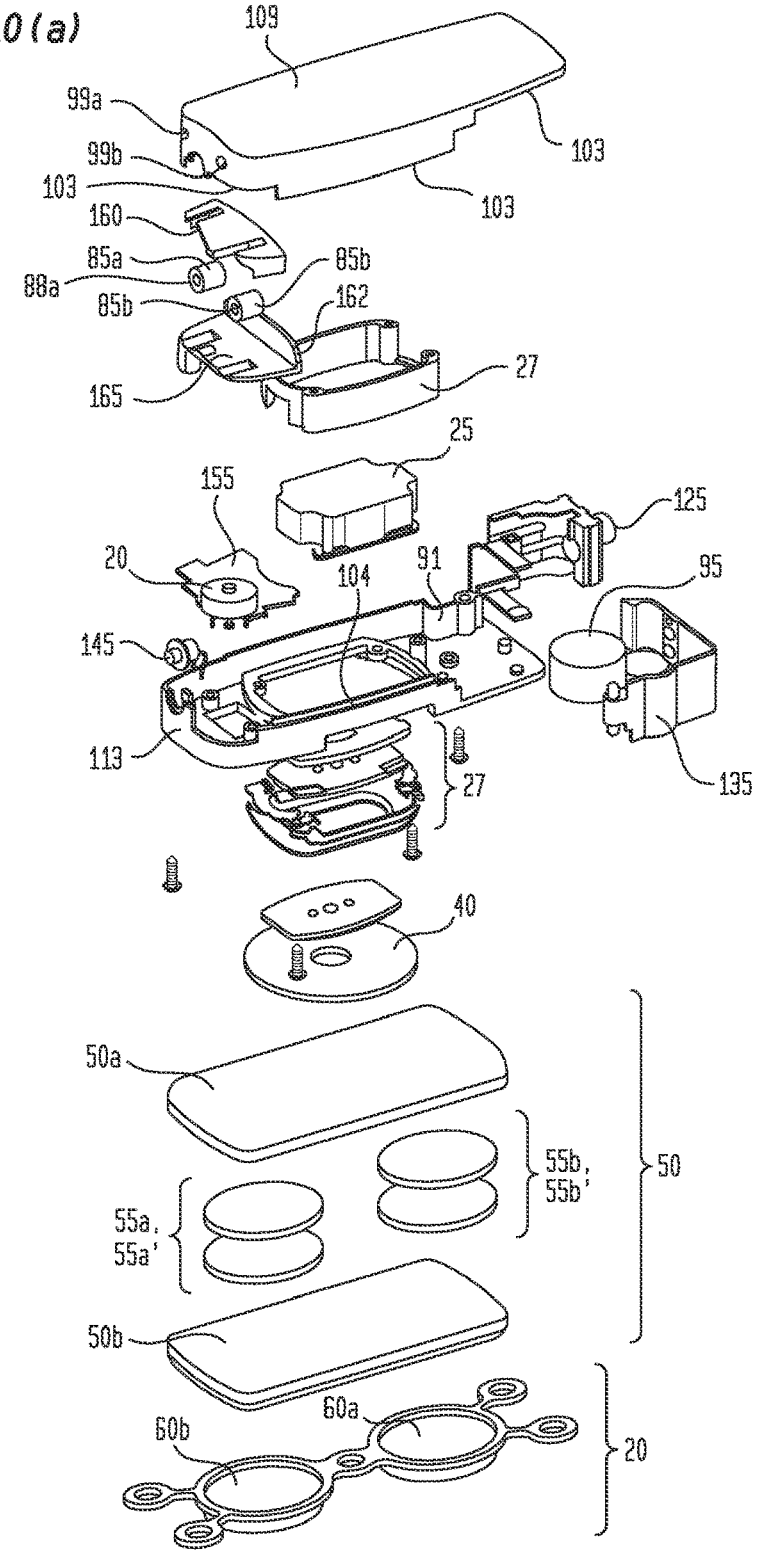
FIGS. 10(*a*), 10(*b*) and 10(*c*) show, respectively, top side perspective exploded, bottom side perspective exploded, and top side perspective assembled partial cut-away views of yet another embodiment of hearing aid with a low profile.
Figure 10B:
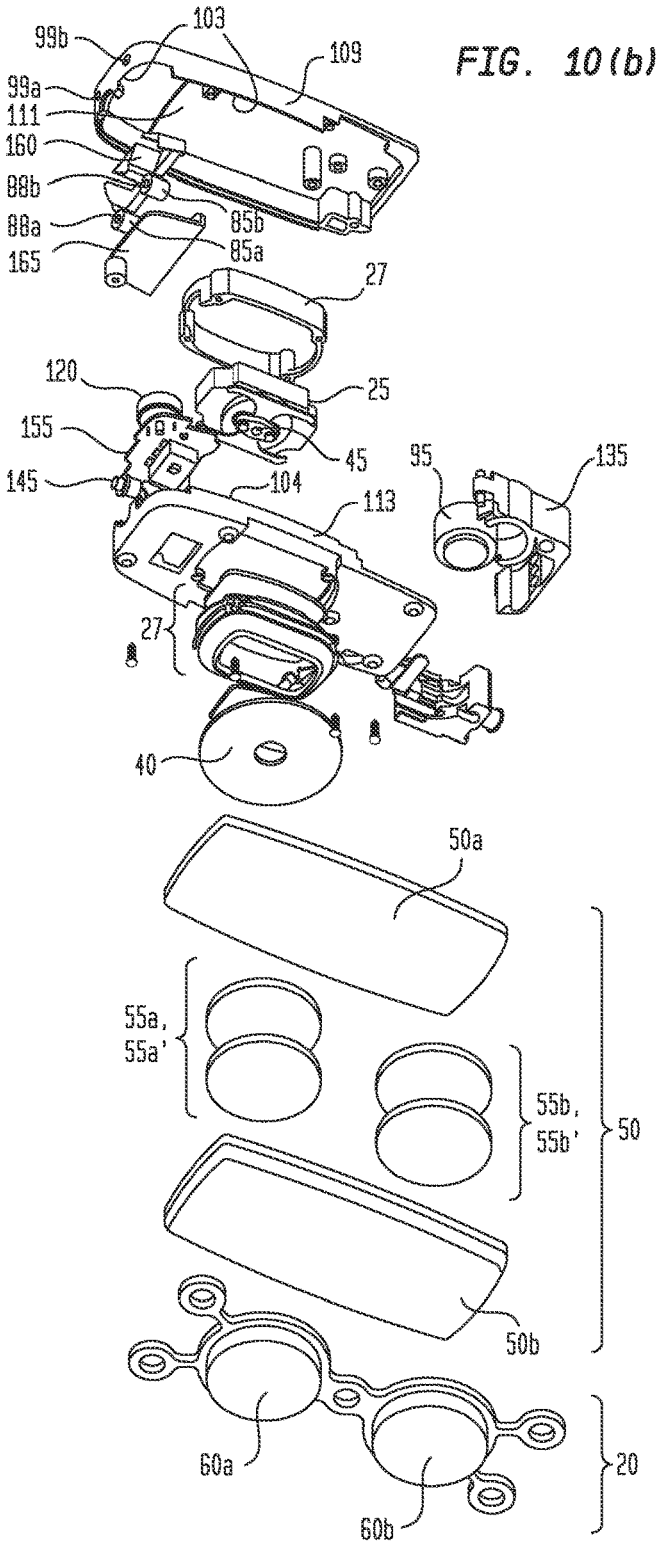
Figure 10C:
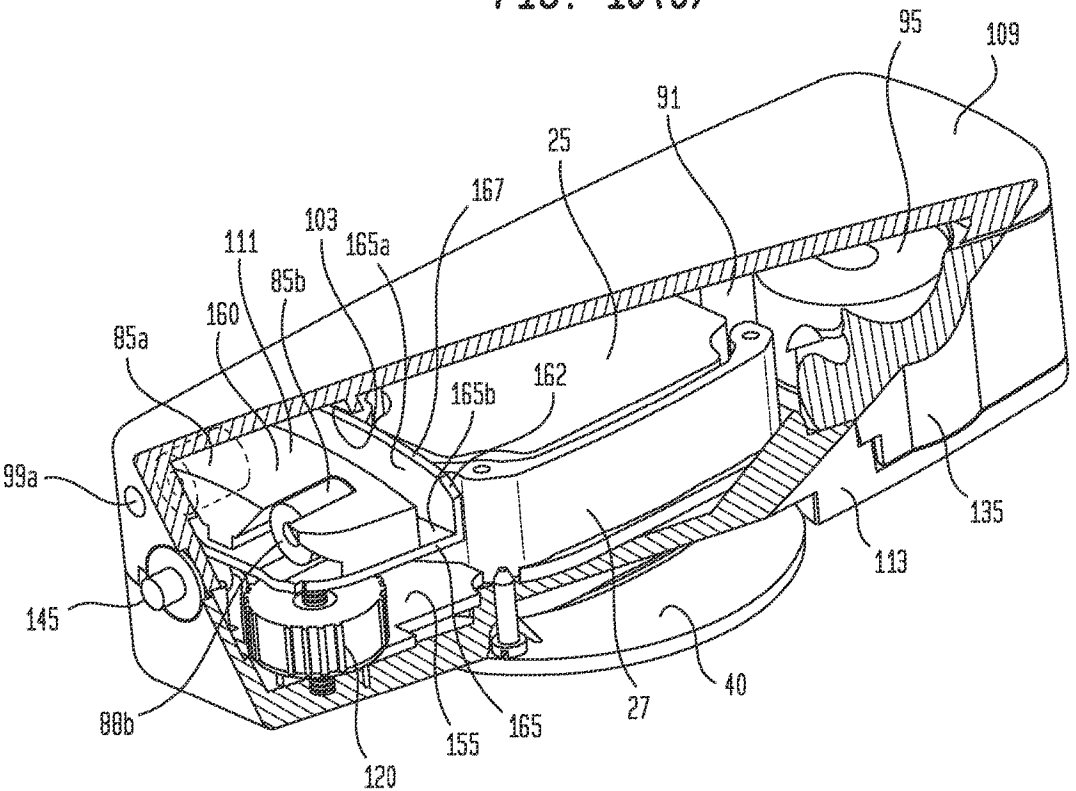
Figure 10D:
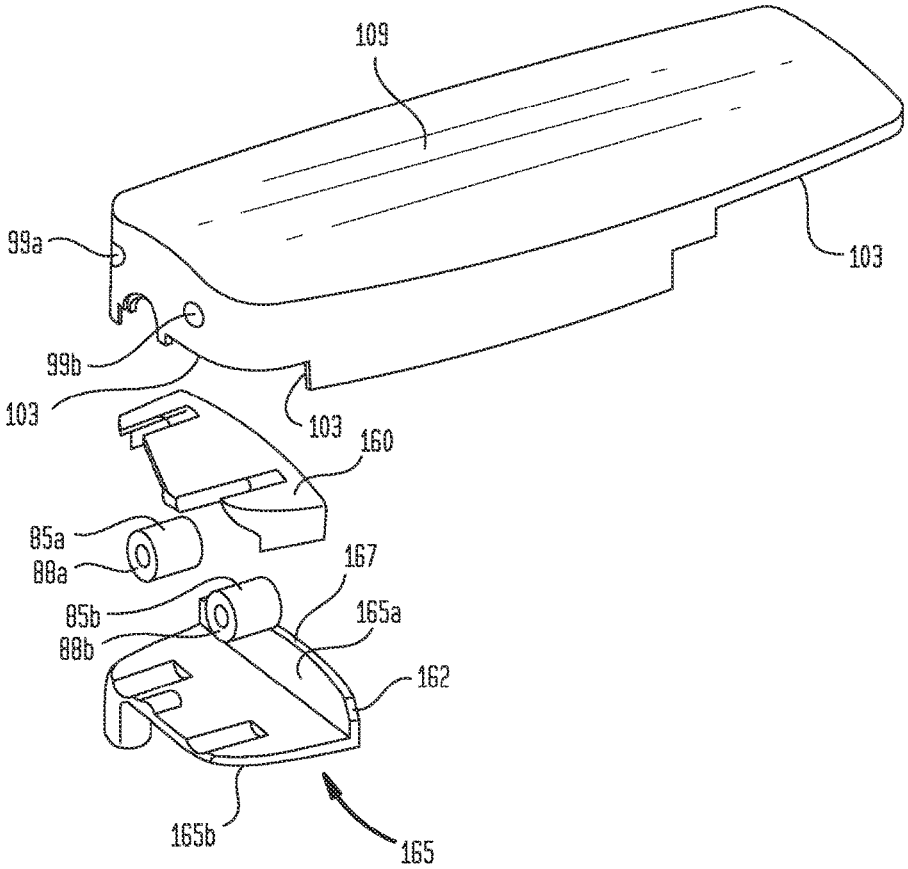
Figure 10E:
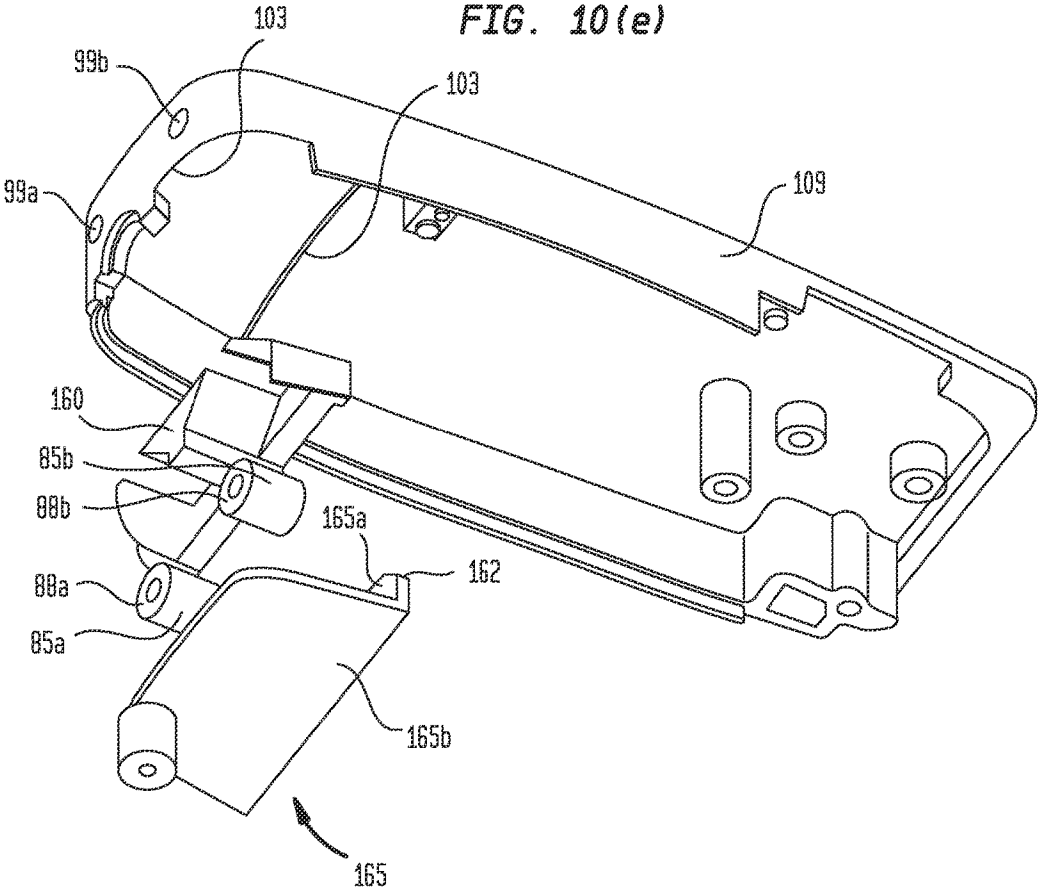

FIGS. 9(*a*) and 9(*b*) show, respectively, bottom side perspective exploded and top side perspective assembled partial cut-away views of a another embodiment of hearing device 10. As shown in FIG. 9(*a*), hearing device 10 comprises upper housing 109 with bottom seam 103 and microphone recesses or holes 99*a* and 99*b*. Microphones 85*a* and 85*b* are configured to fit in holes or recesses 99*a* and 99*b*. Main housing 107 has upper seam 104, which is configured to join against, into or over portions of upper housing 109. Memory select pushbutton 145 enables a patient to select from among different hearing programs. Battery 95 fits within battery compartment 130 and inside battery door 135. Transducer 25 is held by transducer clamp 27 within main housing 107 and second compartment 91 (similar to FIG. 6(*a*)). Transducer coupler 45 operably connects transducer 25 to disk 40 through bottom housing 113. Sound control 120 and printed circuit board 155 are mounted within housings 113 and 107. Transducer suspension 27 cradles transducer 25 within bottom housing 113. Baseplate 50 comprises upper portion 50*a* and bottom portion 50*b*, between are sandwiched baseplate external magnetic members 55*a*, 55*a*', 55*b*, and 55*b*'. Magnetic implant 20 comprises implantable magnets 60*a* and 60*b* mounted in magnetic implant frame 21.

FIG. 9(*b*) shows a top side perspective assembled cut-away view of hearing device 10 of FIG. 9(*a*). First compartment 111 is disposed inside upper housing 109. Second compartment 91 is disposed inside main housing 107. Holes 101*a* and 101*b* (not visible in FIG. 9(*b*)) are configured to accept therethrough wires connected at first ends to microphones 85*a* and 85*b*, and at second ends to printed circuit board 155. Seams 103 and 104 are disposed between main housing 107 and upper housing 109. As described above in connection with FIGS. 6(*a*) through 8, holes 101*a* and 101*b* are filled with a seal, sealing material, adhesive, silicone, or other suitable material or means 93 for effecting an effective acoustic seal to reduce feedback between transducer 25 and microphones 85*a* and 85*b*. Likewise, seam 103, seam 104, and any other holes, seams, breeches, leaks or acoustic passageways disposed between first compartment 111 and second compartment 91 that can be identified, are filled or welded with material 93 to prevent or inhibit the ingress or introduction of undesired acoustic signals emanating from transducer 25 located in second compartment 91 into first compartment 111 through such holes, seams, breeches, holes, leaks or acoustic passageways.

Continuing to refer to FIGS. 9(*a*) and 9(*b*), holes or recesses 99*a* and 99*b* are configured to receive external ends 88*a* and 88*b* of microphones 85*a* and 85*b* therein. External ends 88*a* and 88*b* of microphone 85*a* and 85*b* are positioned flush with, or slightly inwardly from, the external surface of upper housing 109, thereby reducing undesired feedback between transducer 25 and microphones 85*a* and 85*b*. External ends 88*a* and 88*b* of microphones 85*a* and 85*b* are preferably glued or sealed to at least portions of recesses 99*a* and 99*b*.

Figure 11A:
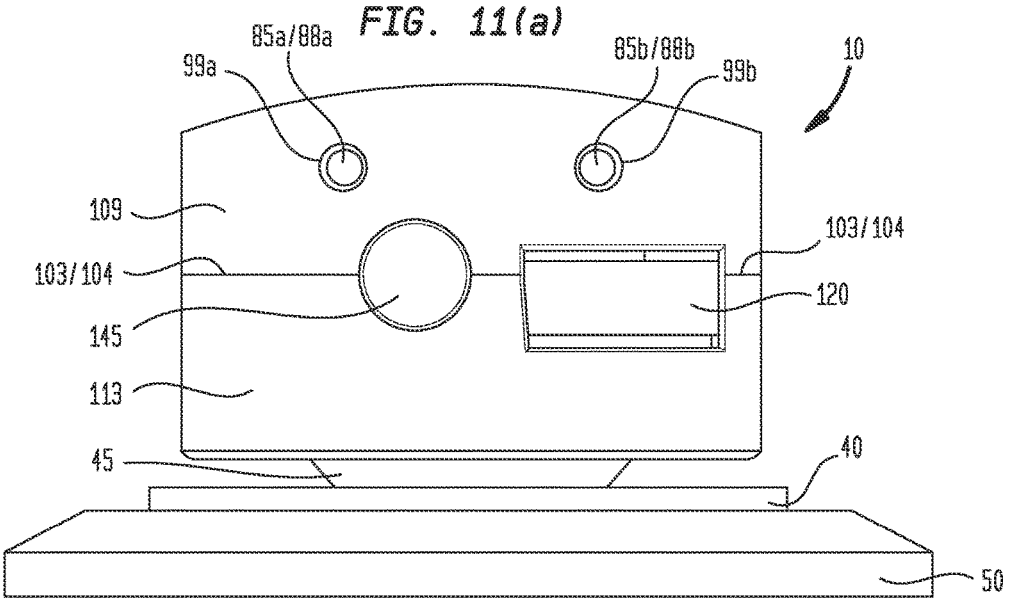
Figure 11B:
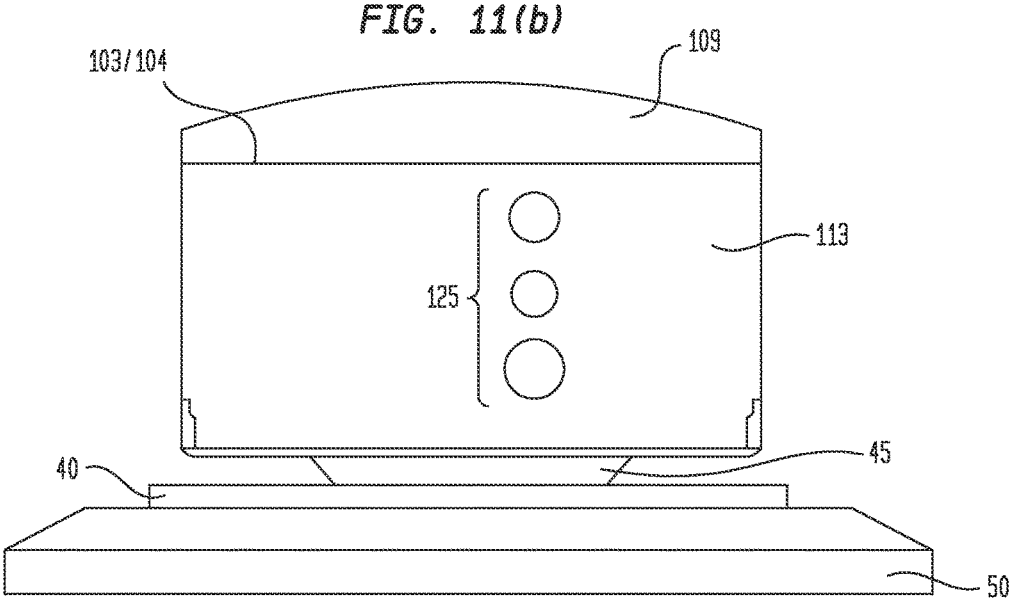

FIGS. 10(*a*), 10(*b*) and 10(*c*) show, respectively, top side perspective exploded, bottom side perspective exploded, and top side perspective assembled partial cut-away views of a yet another embodiment of hearing device 10 with a lower profile than the embodiment shown in FIGS. 9(*a*) and 9(*b*). FIGS. 10(*d*) and 10(*e*) show top side perspective exploded partial views of the lower profile hearing device 10 of FIGS. 10(*a*) through 10(*c*). FIGS. 11(*a*) and 11(*b*) show end views of an assembled hearing device 10 of FIGS. 10(*a*) and 10(*b*). The low-profile embodiment of hearing device 10 shown in FIGS. 10(*a*) through 11(*b*) permits the height and size of hearing device 10 to be reduced relative to the embodiments shown in FIGS. 9(*a*) and 9(*b*).

In the embodiment of hearing device 10 shown in FIGS. 10(*a*) through 11(*b*), the three-piece-housing design of FIGS. 9(*a*) and 9(*b*), which comprises upper housing 109, central or main housing 107, and bottom housing 113, is replaced with a two-piece housing-design, which comprises upper housing 109 and lower or bottom housing 113. In the embodiments of hearing device 10 shown in FIGS. 10(*a*) through 11(*b*), first compartment 111 of FIGS. 9(*a*) and 9(*b*), which is essentially formed by upper housing 109, is replaced and formed by floor and wall 165 in combination with portions of upper housing 109. In FIGS. 10(*a*) through 10(*e*), microphones 85*a* and 85*b* are first positioned and glued, adhered or otherwise secured to microphone positioning cradle 160, which permits and is configured to provide highly accurate positioning of microphones 85*a* and 85*b* within housing 109 and first compartment 111. Cradle 160 is secured or adhered to upper housing 109 such that microphones 85*a* and 85*b* are accurately and properly positioned in microphone recesses 99*a* and 99*b*, respectively. Wall and floor 165, which comprises wall 165*b*, floor 165*a*, and notch 162, is next positioned over positioning cradle 160 and microphones 85*a* and 85*b*, and secured or adhered to upper housing 109.

First compartment 111 (see FIG. 10(*c*)) is thus bounded by floor and wall 165 and portions of upper housing 109. Cradle 160 permits and facilitates highly accurate positioning of microphones 85*a* and 85*b* with respect to upper housing 109. Second compartment 91 (see also FIG. 10(*c*)) is thus bounded by lower housing 113, portions of upper housing 109, and wall and floor 165. Notch 162 (see FIGS. 10(*c*), 10(*d*) and 10(*e*)) permits a first wire connected to microphone 85*a* to be routed from first compartment 111 to second compartment 91 between wall and floor 165 and upper housing 109 to printed circuit board 155. A similar notch (not shown in the drawings) permits a second wire connected to microphone 85*b* to be routed from first compartment 111 to second compartment 91 between wall and floor 165 and upper housing 109 to printed circuit board 155. It has been discovered that these notches or openings 162 must be sealed with a sealing material if feedback between transducer 25 and microphones 85*a* and 85*b* is to be reduced. Seams 103 and 104 are disposed between upper housing 109 and bottom housing 113.

Similar to the embodiments described above in connection with FIGS. 6(*a*) through 9(*b*), notches 162 are filled with a seal, sealing material, adhesive, silicone, or other suitable material or means 93 for effecting an effective acoustic seal to reduce feedback between transducer 25 and microphones 85*a* and 85*b*. Likewise, seam 103, seam 104, and any other holes, seams, breeches, leaks or acoustic passageways disposed between first compartment 111 and second compartment 91 that can be identified, are filled or welded with material 93 to prevent or inhibit the ingress or introduction of undesired acoustic signals emanating from transducer 25 located in second compartment 91 into first compartment 111 through such holes, seams, breeches, holes, leaks or acoustic passageways.

Continuing to refer to FIGS. 10(*a*) through 11(*b*), holes or recesses 99*a* and 99*b* are configured to receive external ends 88*a* and 88*b* of microphones 85*a* and 85*b* therein. External ends 88*a* and 88*b* of microphone 85*a* and 85*b* are positioned flush with, or slightly inwardly from, the external surface of upper housing 109, thereby reducing undesired feedback between transducer 25 and microphones 85*a* and 85*b*. External ends 88*a* and 88*b* of microphones 85*a* and 85*b* are preferably glued or sealed to at least portions of recesses 99*a* and 99*b*.

Note that the various housings 107, 109 and 113, and walls and floors 165 described and disclosed herein are preferably formed of plastic, but may also be formed of other materials, including, but not limited to metals or metal alloys.

In addition to the systems, devices, and components described above, it will now become clear to those skilled in the art that methods associated therewith are also disclosed, such as a method of reducing feedback between a transducer and at least one microphone in a bone conduction magnetic hearing aid comprising providing a first compartment for the at least one microphone, the at least one microphone being configured to detect ambient sounds in a vicinity of the hearing aid, providing a second compartment for the transducer, the transducer being configured to generate acoustic signals for transmission to a patient's skull, the acoustic signals generated by the transducer being representative of the ambient sounds detected by the at least one microphone, and forming one or more seals or welds in one or more seams, breeches, holes, leaks or acoustic passageways disposed between the first compartment and the second compartment with at least one of a sealing material, an adhesive and an ultrasonic weld, the seals being configured to prevent or inhibit the ingress of acoustic signals emanating from the second compartment into the first compartment, and further wherein at least the first compartment, the at least one wall or floor, and the seals are together configured to reduce the amount of feedback occurring between the transducer and the at least one microphone.

It is believed that undesired feedback occurring between transducer 25 and at least one microphone 85 comprises two major components: (a) feedback originating from air waves generated by movement or vibration of transducer 25 within housing 109/113 or 107/113 and the air surrounding same, and (b) feedback originating from body waves transmitted through the materials forming the one or more housings 109/113 or 107/113 of bone conduction hearing device 10, which body waves are transmitted from transducer 25 through housings 109/113 or 107/113 towards least one microphone 85. In further embodiments, therefore, sound dampening and/or attenuating materials, including, but not limited to, silicone, rubber and/or synthetic rubber, or such materials formed into housing seams, layers, gaskets, suspensions and/or other configurations, are placed in the pathway of the body waves between the transducer 25 and at least one microphone 85 to dampen, attenuate and/or absorb such body waves and reduce undesired feedback effects.

It will now be understood that in some embodiments there are provided methods, devices components, and materials to reduce the undesired effects sound emissions from transducer 25 have on at least one microphone 85, which in turn reduces the amount of feedback between transducer 25 and at least one microphone 85. The specific mechanisms by which feedback reduction is effected according to the techniques, devices, components, configurations, arrangements and methods described and disclosed herein are not yet fully understood, but may be due to one or more of attenuation effects, absorption effects, housing resonance effects, or to other effects as yet not understood or fully appreciated. However, when the various feedback reduction techniques, devices, components, configurations, arrangements and methods described and disclosed herein are properly implemented, a surprising amount of reduction in feedback between transducer and at least one microphone occurs.

Various aspects or elements of the different embodiments described herein may be combined to implement wholly passive noise reduction techniques and components, wholly active noise reduction techniques and components, or some combination of such passive and active noise reduction techniques and components.

The foregoing outlines features of several embodiments so that those skilled in the art may better understand the detailed description set forth herein. Those skilled in the art will now understand that many different permutations, combinations and variations of hearing device 10 fall within the scope of the various embodiments. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

After having read and understood the present specification, those skilled in the art will now understand and appreciate that the various embodiments described herein provide solutions to long-standing problems in the use of hearing aids, such eliminating or at least reducing the amount of feedback occurring between transducer 25 and one or more microphones 85.

We claim:

1. A bone conduction magnetic hearing device, comprising:

at least one microphone disposed in a first compartment of the hearing device, the at least one microphone being configured to detect ambient sounds in a vicinity of the hearing device, and a transducer disposed in a second compartment of the hearing device, the transducer being configured to generate acoustic signals for transmission to a patient's skull, the acoustic signals generated by the transducer being representative of the ambient sounds detected by the at least one microphone;

wherein the first compartment is separated from the second compartment by at least one wall or floor, and one or more seals or welds of seams, breeches, holes, leaks or acoustic passageways disposed between the first compartment and the second compartment are configured to prevent or inhibit the ingress of acoustic signals emanating from the second compartment into the first compartment through the seams, breeches, holes, leaks or acoustic passageways, and further wherein at least the first compartment, the at least one wall or floor, and the one or more seals are together configured to reduce the amount of feedback occurring between the transducer and the at least one microphone;

wherein the at least one microphone is operably connected to a microphone guide or cradle, the microphone guide or cradle being disposed within or forming a portion of the first compartment.

2. The hearing device of claim 1, wherein the wall or floor is configured to fit over and contain the microphone guide or cradle within the first compartment.

3. The hearing device of claim 1, wherein the wall or floor includes the microphone guide or cradle.

4. The hearing device of claim 1, wherein the wall or floor is glued or ultrasonically welded to a housing of the hearing device thereby to form the first compartment, the first compartment being acoustically sealed from the second compartment, substantially no unfilled breeches, holes, leaks or acoustic passageways being disposed between the first and second compartments.

5. A method of reducing feedback between a transducer and at least one microphone in a bone conduction magnetic hearing device, comprising:

providing a first compartment for the at least one microphone, the at least one microphone being configured to detect ambient sounds in a vicinity of the hearing device;

providing a second compartment for the transducer, the transducer being configured to generate acoustic signals for transmission to a patient's skull, the acoustic signals generated by the transducer being representative of the ambient sounds detected by the at least one microphone, and forming one or more seals or welds in one or more seams, breeches, holes, leaks or acoustic passageways disposed between the first compartment and the second compartment with at least one of a sealing material, an adhesive and an ultrasonic weld, the seals being configured to prevent or inhibit the ingress of acoustic signals emanating from the second compartment into the first compartment, and further wherein at least the first compartment, the at least one wall or floor, and the seals are together configured to reduce the amount of feedback occurring between the transducer and the at least one microphone;

further comprising operably connecting the at least one microphone to a microphone guide or cradle, the microphone guide or cradle being disposed within or forming a portion of the first compartment.

6. A method of reducing feedback between a transducer and at least one microphone in a bone conduction magnetic hearing device, comprising:

providing a first compartment for the at least one microphone, the at least one microphone being configured to detect ambient sounds in a vicinity of the hearing device;

providing a second compartment for the transducer, the transducer being configured to generate acoustic signals for transmission to a patient's skull, the acoustic signals generated by the transducer being representative of the ambient sounds detected by the at least one microphone, and forming one or more seals or welds in one or more seams, breeches, holes, leaks or acoustic passageways disposed between the first compartment and the second compartment with at least one of a sealing material, an adhesive and an ultrasonic weld, the seals being configured to prevent or inhibit the ingress of acoustic signals emanating from the second compartment into the first compartment, and further wherein at least the first compartment, the at least one wall or floor, and the seals are together configured to reduce the amount of feedback occurring between the transducer and the at least one microphone;

further comprising filling or partially filling the first compartment with one or more of a potting material, a sound attenuating or absorbing material, a flexural sound absorbing material, a resonant sound absorbing material, a poro-elastic material, a porous material, a foam, a polyurethane foam, polymer microparticles, an inorganic polymeric foam, a polyurethane foam, a smart foam, a cellular porous sound absorbing material, cellular melamine, a granular porous sound absorbing material, a fibrous porous sound absorbing material, a closed-cell metal foam, a metal foam, a gel, and an aerogel.

7. A method of reducing feedback between a transducer and at least one microphone in a bone conduction magnetic hearing device, comprising:

providing a first compartment for the at least one microphone, the at least one microphone being configured to detect ambient sounds in a vicinity of the hearing device;

providing a second compartment for the transducer, the transducer being configured to generate acoustic signals for transmission to a patient's skull, the acoustic signals generated by the transducer being representative of the ambient sounds detected by the at least one microphone, and forming one or more seals or welds in one or more seams, breeches, holes, leaks or acoustic passageways disposed between the first compartment and the second compartment with at least one of a sealing material, an adhesive and an ultrasonic weld, the seals being configured to prevent or inhibit the ingress of acoustic signals emanating from the second compartment into the first compartment, and further wherein at least the first compartment, the at least one wall or floor, and the seals are together configured to reduce the amount of feedback occurring between the transducer and the at least one microphone;

further comprising filling or partially filling the second compartment with one or more of a potting material, a sound attenuating or absorbing material, a flexural sound absorbing material, a resonant sound absorbing material, a poro-elastic material, a porous material, a foam, a polyurethane foam, polymer microparticles, an inorganic polymeric foam, a polyurethane foam, a smart foam, a cellular porous sound absorbing material, cellular melamine, a granular porous sound absorbing material, a fibrous porous sound absorbing material, a closed-cell metal foam, a metal foam, a gel, and an aerogel.

* * * * *